US009927092B2

(12) United States Patent
Camarota et al.

(10) Patent No.: US 9,927,092 B2
(45) Date of Patent: Mar. 27, 2018

(54) LED LINEAR LIGHT ASSEMBLY WITH REFLECTANCE MEMBERS

(71) Applicants: Richard Camarota, Holland, MI (US); Thomas C Ward, Alto, MI (US)

(72) Inventors: Richard Camarota, Holland, MI (US); Thomas C Ward, Alto, MI (US)

(73) Assignee: ITC Incorporated, Holland, MI (US)

( * ) Notice: Subject to any disclaimer, the term of this patent is extended or adjusted under 35 U.S.C. 154(b) by 199 days.

(21) Appl. No.: 14/923,484

(22) Filed: Oct. 27, 2015

(65) Prior Publication Data

US 2016/0356454 A1 Dec. 8, 2016

Related U.S. Application Data

(60) Provisional application No. 62/170,998, filed on Jun. 4, 2015, provisional application No. 62/073,531, filed on Oct. 31, 2014.

(51) Int. Cl.

| | |
|---|---|
| ***F21V 7/00*** | (2006.01) |
| ***F21V 21/34*** | (2006.01) |
| ***F21V 7/10*** | (2006.01) |
| ***F21V 21/005*** | (2006.01) |
| ***F21V 23/06*** | (2006.01) |
| ***F21S 4/24*** | (2016.01) |
| ***F21V 14/04*** | (2006.01) |
| *F21W 131/405* | (2006.01) |
| *F21Y 103/10* | (2016.01) |
| *F21Y 115/10* | (2016.01) |

(52) U.S. Cl.

CPC ..... *F21V 7/005* (2013.01); *F21S 4/24* (2016.01); *F21V 7/10* (2013.01); *F21V 14/04* (2013.01); *F21V 21/005* (2013.01); *F21V 21/34* (2013.01); *F21V 23/06* (2013.01); *F21W 2131/405* (2013.01); *F21Y 2103/10* (2016.08); *F21Y 2115/10* (2016.08)

(58) Field of Classification Search

CPC ..... F21Y 2101/02; F21Y 2103/003; F21V 7/005; F21V 7/10; F21V 21/005; F21V 21/34; F21V 23/06; F21S 4/24; F21S 4/26; F21W 2131/405

USPC ..... 362/219, 322, 287, 297, 241, 247, 282, 362/283

See application file for complete search history.

(56) References Cited

U.S. PATENT DOCUMENTS

| | | | |
|---|---|---|---|
| 3,984,923 | A | 10/1976 | Rawson |
| 4,159,490 | A | 6/1979 | Wood |
| 4,488,237 | A | 12/1984 | Aronson |
| 5,266,123 | A | 11/1993 | Brand |

(Continued)

*Primary Examiner* — Laura Tso

(74) *Attorney, Agent, or Firm* — Varnum, Riddering, Schmidt & Howlett LLP

(57) ABSTRACT

A shelf light (300) is provided as an LED linear light assembly (300) having a flexible LED linear light component (302), with a series of LEDs mounted on printed circuit boards (PCB's) (308). The light component (302) has a double channel (304) with an extended aluminum track. An LED PCB jacket (306) encloses the light component (302) and is of uniform thickness. Reflectance members (310) comprise a pair of members (312, 314), each having an elongated configuration and mounted on opposing sides of the light assembly (300). Movement of the reflectance members (312, 314) permits variation of apertures of reflectance, thus varying the light intensity and direction.

16 Claims, 15 Drawing Sheets

(56) References Cited

U.S. PATENT DOCUMENTS

| | | | | |
|---|---|---|---|---|
| 5,363,865 | A | 11/1994 | Brand | |
| 6,827,472 | B1 | 12/2004 | Myburgh | |
| 7,045,971 | B2 | 5/2006 | Goto | |
| 7,160,019 | B1 | 1/2007 | Kawakami | |
| 7,253,444 | B2 | 8/2007 | Ikeda | |
| 7,709,292 | B2 | 5/2010 | Sadwick | |
| 7,726,868 | B2 | 6/2010 | Terada | |
| 7,758,230 | B2 | 7/2010 | Terada | |
| 7,768,658 | B2 | 8/2010 | Tsai | |
| 7,815,359 | B2 | 10/2010 | Shimura | |
| 8,134,675 | B2 | 3/2012 | Kawaguchi | |
| 8,322,883 | B2 | 12/2012 | Cleaver | |
| 2003/0193801 | A1* | 10/2003 | Lin | F21S 4/26 362/555 |
| 2003/0193803 | A1* | 10/2003 | Lin | F21S 4/24 362/249.04 |
| 2004/0184288 | A1 | 9/2004 | Bettis | |
| 2004/0228135 | A1 | 11/2004 | Myburgh | |
| 2005/0168985 | A1* | 8/2005 | Chen | F21V 19/001 362/241 |
| 2007/0263385 | A1* | 11/2007 | Fan | G09F 13/22 362/249.16 |
| 2008/0007945 | A1* | 1/2008 | Kelly | A47F 3/001 362/218 |
| 2008/0159694 | A1 | 7/2008 | Payne | |
| 2009/0073692 | A1 | 3/2009 | Berger | |
| 2010/0201239 | A1 | 8/2010 | Mostoller | |
| 2012/0069556 | A1* | 3/2012 | Bertram | F21V 23/02 362/217.14 |
| 2012/0170258 | A1 | 7/2012 | VanDuinen | |
| 2013/0018352 | A1 | 1/2013 | Wu | |
| 2013/0082989 | A1 | 4/2013 | Song | |
| 2013/0107526 | A1 | 5/2013 | Ishibashi | |
| 2014/0063793 | A1* | 3/2014 | Hasan | F21V 31/005 362/184 |
| 2014/0301063 | A1* | 10/2014 | Hikmet | F21V 9/16 362/84 |
| 2015/0098228 | A1* | 4/2015 | Simon | F21K 9/17 362/311.02 |
| 2016/0131311 | A1* | 5/2016 | Qin | F21S 4/28 362/92 |

* cited by examiner

LED LINEAR LIGHT ASSEMBLY WITH REFLECTANCE MEMBERS

CROSS-REFERENCE TO RELATED APPLICATIONS

This Application claims priority of U.S. Provisional Patent Application Ser. No. 62/170,998, filed Jun. 4, 2015, and U.S. Provisional Patent Application No. 62/073,531, filed Oct. 31, 2014.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable.

REFERENCE TO A "SEQUENCE LISTING," TABLE OR COMPUTER PROGRAM LISTING APPENDIX

Not Applicable.

BACKGROUND OF THE INVENTION

Field of the Invention

The invention relates to lighting configurations and, more particularly, to configurations in the form of flexible LED linear lights adapted for use with refrigerated and non-refrigerated cabinetry, and further adapted for use with reflectance members.

Background Art

As part of the background for the present invention, this application sets forth a detailed discussion of lighting configurations using flexible LED linear lights with diffusion properties. This subject matter is disclosed in a previously filed U.S. patent application which is commonly owned and was granted application Ser. No. 14/467,384 filed on Aug. 25, 2014. The application is titled DIFFUSED FLEXIBLE LED LINEAR LIGHT ASSEMBLY, Camarota, et al. (the "Camarota Application"). FIGS. 1-21 of this current application are also described in the Camarota Application. As will be made apparent from supplemental discussion herein, the invention to which this current application is directed differs substantially from the invention covered by the Camarota Application. For example, the primary invention covered by the Camarota Application is directed to a linear light assembly utilizing properties of diffusion. In contrast, the present invention does not necessarily employ diffusion principles. However, an understanding of properties of diffusion is helpful in understanding some of the basic principles of linear light assemblies associated with the present invention. Further, the disclosure of the Camarota Application, as partially replicated herein, describes a flexible tape light assembly and concepts associated therewith. Certain of these concepts associated with flexible tape light assemblies as described in the Camarota Application are incorporated within the present invention. General background concepts associated with electrical lighting will now be described.

Various types of electrical lighting systems have been known and developed throughout the years since the early days of Edison's inventions. Originally, most electrical lighting (in the form of light bulbs and the like) existed for functional and generally practical uses, namely to provide illumination in what would otherwise be relatively dark spatial areas. As electrical lighting development matured, alternatives to conventional light bulbs were the subject of numerous inventions and other developments. For example, fluorescent lighting was developed. Fluorescent lamps or tubes are typically relatively low pressure mercury vapor gas discharge lamps which use fluorescence to produce visible light. Electrical current in the gas excites mercury vapor which produces short-wave ultraviolet light. It then causes a phosphor coating on the inside of the bulb to fluoresce, thereby producing visible light. Fluorescent lighting typically converts electrical power into usable light relatively more efficiently than incandescent lamps.

Although fluorescent lighting is used in both retail and commercial establishments, it has some disadvantages. Often, fluorescent light fittings are relatively bulky, and inconvenient for use in restricted spaces such as display cases and the like. Also, such light fittings can have a relatively short life and require frequent maintenance. Still further, fluorescent lighting can operate at a somewhat hazardous high voltage, with respect to the requirements of a starter/ballast.

Fluorescent lamps and gas discharge lamps have existed for a significant period of time, originally being displayed by Tesla in 1893 at the World Colombian Exhibition. In 1897, Nernst invented and patented his incandescent lamp, based primarily on solid state electrical lights. Other significant developments occurred throughout the 20th century. In 1901, Peter Hewitt demonstrated a mercury vapor lamp. In 1981, Philips first marketed what was characterized as compact fluorescent energy saving lamps, with integrated conventional ballast. In 1985, Osram, in competition with Philips, started to market an electronic energy saving lamp. Shortly thereafter, the "white" sodium vapor lamp was introduced.

Other developments included ceramic metal halide lamps (originally developed by a team at Nela Parc in 1992). In 1994, T-5 lamps having a cool tip were introduced and became the most popular fluorescent lamps, with what was considered to be excellent color rendering. Also developed in this timeframe was the first commercial sulfur lamp.

In addition to the foregoing developments, Nick Hollnyak is credited with developing the first practical spectrum Light Emitting Diode (LED) in 1962. However, in fact, the general LED has been around, at least at a theoretical level, since initially discovered in the first decade of the 20th century.

Hollnyak is typically credited as the father of the modern LED. An LED can generally be defined as a semi-conductor light source. When an LED is switched on, electrons are able to recombine with holes within the device, releasing energy in the form of photons. This effect is commonly referred to as electroluminescence and the color of the light is determined by the energy gap of the semi-conductor. LEDs present many advantages over incandescent light sources, including lower energy consumption, longer lifetime, improved physical robustness, smaller size, and faster switching. LEDs have been used in numerous applications, as diverse as aviation lighting, digital microscopes, automotive lighting, advertising, general lighting, and traffic signals. Their high switching rates are also useful in advanced communications technology.

One use for LED configurations which has become more popular during the last several years is the application of LEDs for lighting fixtures which may provide some functional illumination, but also act as decorative lighting assemblies. LED configurations which are useful for decorative lighting assemblies include both rigid LED linear lights and flexible LED lights, including both indoor and outdoor applications. Rigid LED lights comprise LEDs conventionally mounted on a structure which links the LEDs together both electrically and physically. A housing surrounding the LED strip often consists of a rigid PVC material. These rigid light arrays are typically mounted through adhesive backings to the desired structures. In contrast, and as described in the section titled "Detailed Description of the Preferred Embodiments," the invention relates in part to a "flexible LED linear light assembly" which utilizes a series of spaced apart and electrically linked LEDs which are mounted on a flexible printed circuit board ("PCB"). In addition to the flexible PCB, the flexible LED linear light assembly further consists of a flexible housing or lens, as opposed to the use of a rigid housing. Further, the LEDs may be surface mounted to a flexible polymer PCB.

Flexible LED linear lights can be utilized in many applications. For example, such lights can be applied as indoor lighting for outlining the edges of a kitchen counter, or under-lighting baseboards in a movie theatre and similar environments. Flexible LED linear lights can also be utilized as outdoor lighting, including staircase lighting, outdoor patio or deck lighting, signage and outdoor artistic displays. Flexible LED linear lights are also suitable for use around a garden, pool, driveway, shed or the like. In addition, during holiday seasons, flexible LED linear lights can be readily used to create artistic messages or designs utilizing different colors and patterns.

With the foregoing issues in mind, reference is now made to a number of patents and patent application publications which are associated with LED strings, translucent housing members and/or other optical and electrical principles. For example, the commonly assigned U.S. Patent Application Publication to VanDuinen et al., 2012/0170258, published Jul. 5, 2015 is directed to displays of case lighting having a lens with integrally formed features on its interior for purposes of mechanically retaining LED units within the interior. At least one of the LED units consists of a base and diodes mechanically engaged on a rigid PCB with integrally formed features of the lens. An electrical connector is provided to connect the LED units to a power source. At least one end cap incorporates the electrical connector. For purposes of sealing the assembly, a boot seal is provided for sealing the electrical connector and a plug cover is used to cover any unused electrical connectors which may be provided. An adhesive is used to secure the end cover to the lens and seal the connection therebetween. With this configuration, the lighting assembly is suitable for use in wet or potentially explosive environments.

The U.S. Patent to Ikeda, U.S. Pat. No. 7,253,444, issued Aug. 7, 2007 is directed to a structure and process for manufacturing the structure which consists of a casing for use with a light-emitting unit. Ikeda discloses the concept of the unit having a substrate and light-emitting diodes housed within the casing. When silicone is injected through an injection opening, the silicone flows through the entirety of the housing, and then overflows from a discharge opening. The purpose for the silicone injection is to "push outside" air or air bubbles which have formed within the light-emitting unit.

The U.S. Patent Application Publication to Ishibashi et al., 2013/0107526, published May 2, 2013 is directed to the use of cluster boards, with a series of LEDs mounted in an array on central parts of the boards in a transverse direction of the boards. The LED mounting portions in the first and second boards are formed so as to be bendable.

The U.S. Patent Application Publication to Mostoller et al., 2010/0201239, published Aug. 12, 2010 is directed specifically to an end cap configuration for a light tube having a LED light string. The end cap assembly includes an end cap connector extending from the body and holding contacts with first mating portions configured so as to be electrically connected to the circuit board, and second mating portions configured to electrically connect to the socket connector. The end cap assemblies of Mostoller et al. do not provide for any flush mounting of the cap with an outer surface of the housing profile.

The U.S. Patent to Goto, U.S. Pat. No. 7,045,971, issued May 6, 2006 is directed to an illuminating apparatus having full-color LEDs, with a controller and power supply cable. The light emitting unit includes a series of light emitting elements having different emission colors. Other than showing a string of full-color LEDs for decorative purposes, the Goto patent does not appear to have any significant relevance.

The U.S. Patent Application Publication to Kelly, et al., 2008/0007945, published Jan. 10, 2008 is directed to a cabinet illuminator having a pair of LED lines. The LED lines are found in an elongated body having a heat transfer portion for conduction of heat from the LEDs to the outer surface of the body. An engagement configuration exists in the ends of the body for engagement with other structural members of a display cabinet. The end connectors do not appear relevant to the ITC invention.

The U.S. Patent to Terada, et al., U.S. Pat. No. 7,758,230, issued Jul. 20, 2010 discloses a spread illuminating apparatus having an LED, with a transparent resin plate and a light reflecting sheet. The plate includes slits adapted to have flap portions of the light reflecting sheet inserted therein. An adhesive tape with flexibility is placed along at least one flat portion of the reflecting sheet, so as to cover at least one slit of the resin plate. The light reflecting sheet is prevented from warping or undulating in spite of the difference in thermal expansion coefficients between the materials of the resin plate and the reflecting sheet. Light emitted from the LED and traveling in the resin plate is totally reflected by the flat portions, and thereby prevented from leaking from the outer side surfaces of the resin plate.

Other references include the following:

- The U.S. Patent Application Publication to Berger, et al., 2009/0073692, published Mar. 19, 2009 is directed to a modular and expandable lighting system.
- The U.S. Patent Application Publication to Payne, 2008/0159694, published Jul. 3, 2008 is directed to a lens configuration for optical touch systems.
- The U.S. Patent to Shimura, et al., U.S. Pat. No. 7,815,359, issued Oct. 19, 2010 is directed to a spread illuminating apparatus utilizing a transparent resin plate.
- The U.S. Patent to Terada, et al., U.S. Pat. No. 7,726,868, issued Jun. 1, 2010 is directed to a spread illuminating apparatus, and is primarily related to a method of injection molding for the transparent resin plate.
- The U.S. Patent to Kawakami, U.S. Pat. No. 7,160,019, issued Jan. 9, 2007 is directed to a side-lighting surface light source device, along with a manufacturing method for the same. The device includes a light source, reflective member, and light guide plate.

The following patents and applications are directed to various types of display devices utilizing LED configurations.

Song, et al., Publication No. 2013/0082989;
Kawaguchi, et al., U.S. Pat. No. 8,134,675;
Myburgh, U.S. Publication No. 2004/0228135.

Other patents and applications utilizing LED string apparatus include the following:

Sadwick, et al., U.S. Pat. No. 7,709,292;
Rawson, et al., U.S. Pat. No. 3,984,923;
Aronson, et al., U.S. Pat. No. 4,488,237;
Brand, U.S. Pat. No. 5,266,123;
Brand, U.S. Pat. No. 5,363,865;
Myburgh, U.S. Pat. No. 6,827,472;
Wood, U.S. Pat. No. 4,159,490;
Bettis, 2004/0184288;
Yoshida, et al., 2013/018352;
Tsai, et al., U.S. Pat. No. 7,768,658.

The background or prior art which has been described in the prior paragraphs related to advantages associated with the use of diffusion for various light assemblies. However, it is advantageous if various lighting structures can be developed and utilized without requiring the structures necessary for diffusing the light. In this regard, one step toward not requiring the use of diffusion principles would be to not having concerns with regard to hot spots or the like.

Also, it would be advantageous if light could be reflected and varied in intensity within one structure, without requiring completely different light assemblies to achieve differing light effects. Still further, it would be advantageous to achieve the foregoing advantages without requiring significant expense with regard to the initial construction of the light assemblies or with respect to replacement of component parts of the assemblies. It is to these concepts of achievement of non-diffused light assemblies having advantageous characteristics to which the current application is directed.

SUMMARY OF THE INVENTION

An LED linear light assembly in accordance with the invention is adapted for use as an LED-based source of light for illuminating product which is not sufficiently illuminated by ambient sources. The light assembly includes an elongated flexible LED light component having a series of spaced-apart LEDs supported on a flexible base. At least one metallic supporting track is provided for supporting the linear light component. An extruded sleeve having an elongated configuration is provided for laterally enclosing the flexible LED linear light component. The sleeve includes at least a portion forming a section with translucent properties. Reflectance means are coupled to the sleeve for providing one or more reflective surfaces, and positioned relative to the light emanating from the LED light component, so as to achieve a pre-determined light distribution.

The reflective means can include at least one reflectance member coupled to other elements of the linear light assembly. In one embodiment of the invention, the reflectance member is configured and constructed relative to other elements of the linear light assembly, so as to be maintained in a stationary position following initial installation of the light assembly. In accordance with other embodiments of the invention, the reflectance member can be coupled to other elements of the linear light assembly so as to be adjustably positionable relative to the LED light component, and so as to permit adjustment of reflected light distribution for the linear light assembly.

In a still further embodiment, the reflective means includes at least two reflectance members, with each reflectance member providing one or more reflective surfaces. In one embodiment having at least two reflectance members, at least one of the reflectance members is maintained stationary relative to the LED light component, while the second one of the two reflectance members is adjustably positionable relative to the light component. In a still further embodiment of the invention, the light assembly can include at least two of the reflectance members, with each reflectance member being maintained stationary relative to other components of the linear light assembly.

In accordance with other aspects of the invention, the reflective means includes at least one reflectance member having an elongated and wing-like configuration. In a still further embodiment of the invention, the reflective means includes at least one reflectance member coupled to other elements of the linear light assembly, with the reflectance member being angularly adjustable relative to the LED light component between a first pre-determined minimum angle and a second pre-determined maximum angle.

The reflective means can include at least one reflectance member, and the light assembly can be constructed and configured so that selectable positioning of the reflectance member provides for variable apertures of reflectance, and also provides for substantial variations in the resultant intensity of light originating from the LED light component and reflected off of the reflectance member.

With respect to a still further embodiment of the invention, the linear LED light component can be positioned on the metallic supporting track so as to be at a fixed, acute angular relationship with the supporting rack.

The linear light assembly can operate with an absence of diffusion of LED generated light. The reflectance member can be appended to a side of the extruded channel through a cylindrical pivot. The reflective means can be operable so as to provide a variable aperture of reflectance. In another embodiment of the invention, at least one reflectance member can be utilized for concentration and direction of LED generated light positions beneath or behind the location of the light component.

The reflectance member can be constructed at least in part of plastic material. Further, the light assembly can include a double channel for supporting a pair of elongated flexible LED linear light components. Still further, the linear light assembly can include coupling means provided for electrically coupling together a series of individual ones of the linear light assemblies, so as to produce a structure where the light assemblies are daisy chainable for a pre-determined distance, the pre-determined distance dependent upon electrical and structural characteristics of the light assemblies.

In accordance with other aspects of the invention, the extruded sleeve can be characterized as an LED encasement sleeve, sized and configured so as to exhibit an absence of diffusive characteristics. The LED light component can be an LED tape light component configured with the metallic track, so as to be replaceable in the track without the requirement of complex tooling and with the capability of performing such replacement on site.

The encasement sleeve can have a rectangular cross-sectional configuration. The encasement sleeve can also be constructed of a clear material. The light assembly can also be constructed so as to provide an encapsulated product which will pass through the sleeve a substantially maximum amount of light, given pre-determined power requirements and operating characteristics of a given set of LEDs. One configuration in accordance with the invention provides for obtaining a substantially maximum amount of light when the light assembly is configured so that light from the assembly is directly viewed.

The LED encasement sleeve can be of a uniform thickness. The light assembly can include an elongated flexible LED tape light component supported on a flexible base. At least one reflectance member section can have an elongated and planar configuration, and be appended to at least one side of a track of the light assembly, and a reflectance member assembly.

BRIEF DESCRIPTION OF THE DRAWINGS

The invention will now be described with respect to the drawings, in which:

FIG. 8 is an upper, perspective view of the end cap lead in;

FIG. 9 is an elevation view of the end cap lead in shown in FIG. 8, as viewed from the interior of the diffused flexible LED linear light assembly, and looking outwardly toward the interior face of the end cap lead in;

FIGS. 36 and 37 comprise illustrations of elements consisting of a mounting kit for use with the reflectance member light assembly in accordance with the invention, with FIG. 36 being an upper, right side perspective view of a plastic clip and magnet of the mounting kit, while FIG. 37 is a side, elevation view of a conventional flat head screw utilized with the mounting kit;

DETAILED DESCRIPTION OF THE PREFERRED EMBODIMENTS

Figure 1:
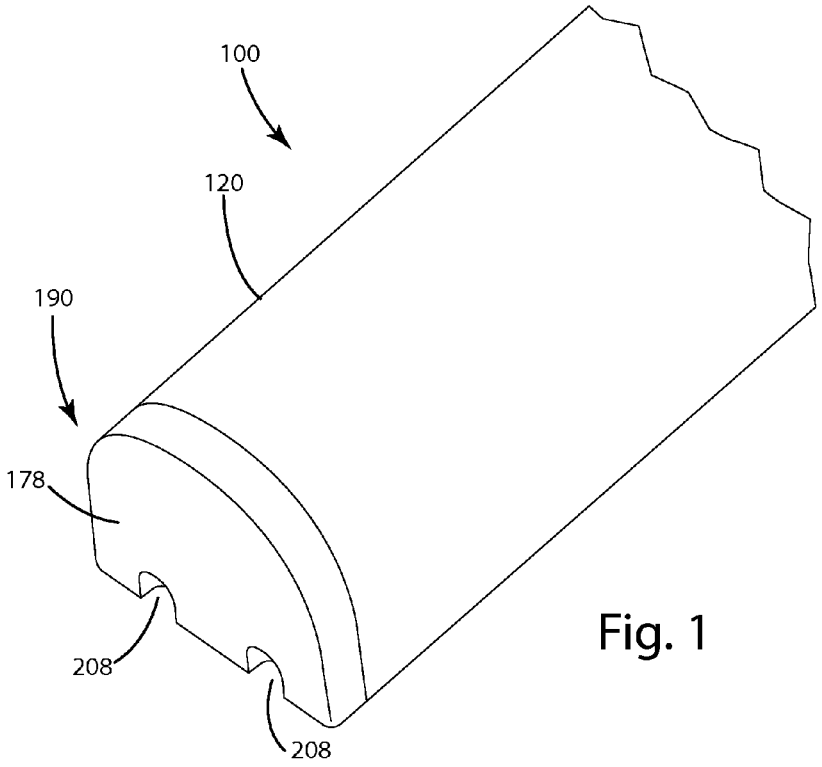
FIG. 1 is a left-side perspective view of a partial length of a prior art diffused flexible LED linear light assembly.
Figure 2:
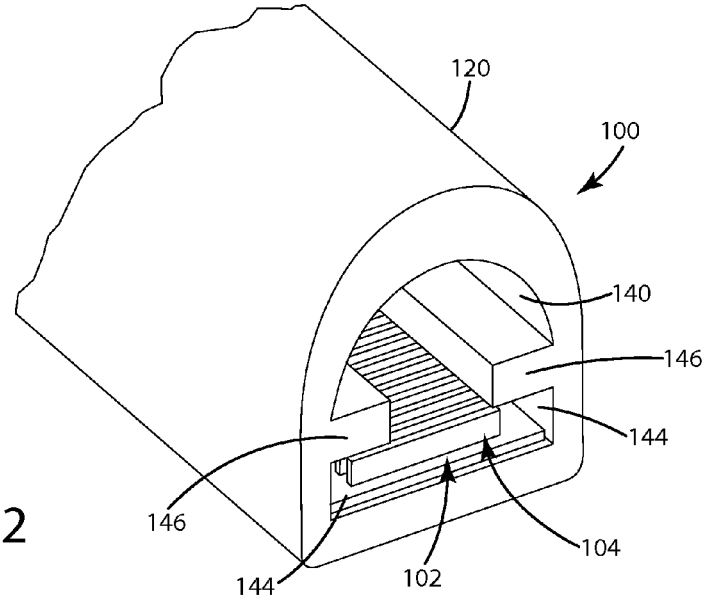
FIG. 2 is a right-side perspective view of the diffused flexible LED linear light assembly shown in FIG. 1, but further showing a partial interior of the flexible LED linear light assembly, with FIG. 2 showing one end of a translucent housing, with an end cap omitted from the end of the housing, and therefore partially showing an interior of the translucent housing, with the flexible LED linear light located against the bottom of the "D-shaped" translucent housing, and further showing a pair of opposing inner projections which serve to locate the flexible LED linear light within a channel formed by the two opposing projections.
Figure 3:
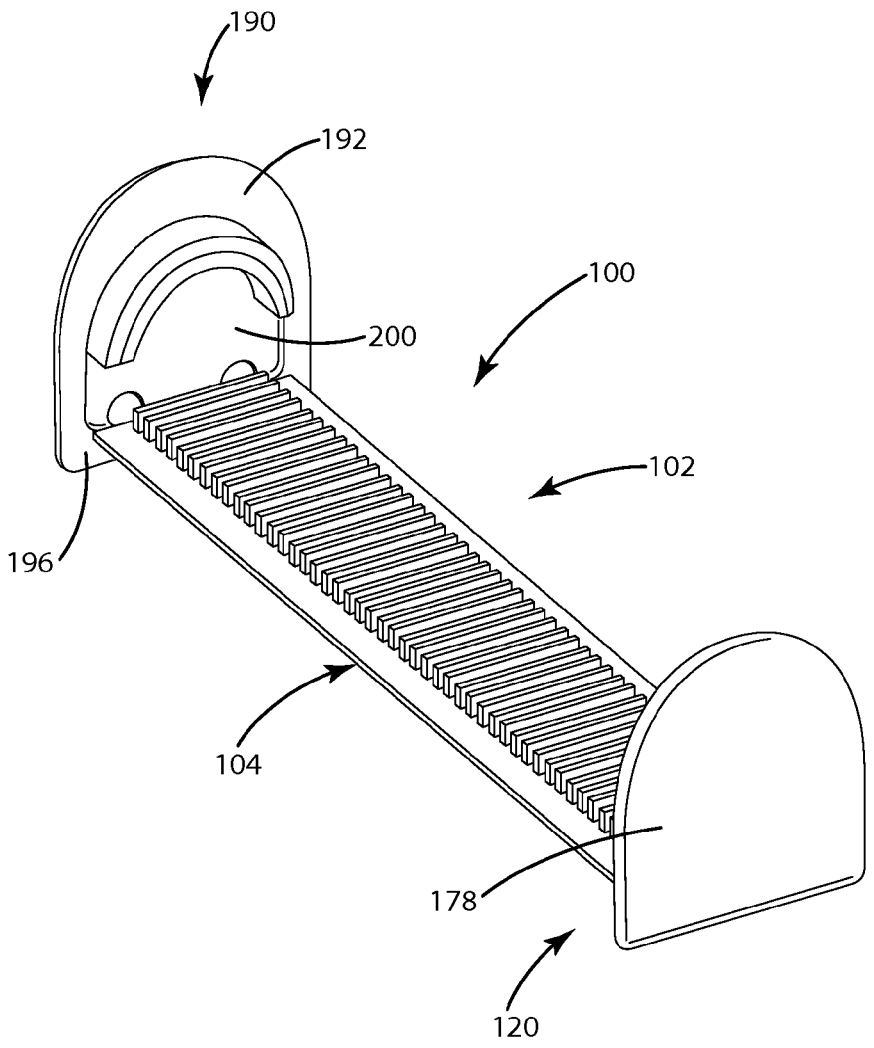
FIG. 3 is a perspective view of the flexible LED linear light assembly shown in FIG. 1, showing one of the end caps, and further with the omission of the translucent housing structure.

The principles of the invention are disclosed, by way of example, in a LED linear light assembly with reflectance members. The embodiments of the invention are also referred to as canopy lights, shelf lights and similar structures. The lights for the light assembly with reflectance members in accordance with the invention are illustrated in FIGS. 22-47, and disclosed in subsequent paragraphs herein. A substantial advance in LED lighting technology is the subject of the previously identified Camarota Application. For purposes of detailed background and understanding for the invention covered by this application, the Camarota Application is described in substantial detail in the immediately following paragraphs, and is also illustrated in FIGS. 1-21.

Notwithstanding the technology advancements associated with the Camarota Application, it should be emphasized that the inventions covered by this application comprise concepts which are neither taught nor suggested by the subject matter of the Camarota Application. On the other hand, however, certain components which have been developed and employed in the light assemblies described in the Camarota Application can also be utilized with the embodiments of the current inventions. For example, the "light engine" utilized in embodiments of the current invention may have some substantial similarities in construction and function to that of the light engine which may be utilized in the Camarota Application. However, substantial differences exist for other structure and functional elements of the separate embodiments and inventions. For example, a principal concept associated with the Camarota Application and invention disclosed therein relates to the concept that the light generated with the Camarota Application invention is diffused. For this purpose, an LED encasement sleeve utilized with the Camarota Application is domed. In contrast, the light generated by the LED assemblies with the current invention do not require any linear light diffusion. The extruded LED encasement sleeve utilized with the current invention can be rectangular in shape, as opposed to being domed. Also, the encasement sleeve for the LED assembly can be constructed of clear material.

In this regard, certain concepts of the current invention are directed to the production of an encapsulated product that will pass the maximum amount of light for certain applications, such as refrigerated and non-refrigerated cabinetry. As discussed in some of the immediately following paragraphs, the prior Camarota Application was directed to the illumination of both dark zones and hot spots for the associated linear light assemblies. In the current invention, the light assemblies will not be utilized for a direct viewing. Accordingly, hot spots are not an issue and diffusion techniques do not have to be utilized for the light emanating from the LEDs.

Turning to another aspect associated with the invention, a method of manufacture, utilizing internal ribs is being utilized. It may be noted that this manufacturing method utilizing the internal ribs was also applicable to the Camarota Application invention.

In producing display linear lights, manufacturers have been known to employ a rigid printed circuit board (PCB) mounted in an extruded aluminum track. These light assemblies include protective lenses. In contrast, and in accordance with several concepts of the current invention, a flexible tape LED array is utilized to provide the LED lighting itself. One particular advantage is that such flexible tape LED arrays are relatively inexpensive. The flexible tape LED arrays can be supported within aluminum tracks. These flexible arrays are replaceable within the tracks, without replacing a substantial portion or other elements of the light assembly. In addition, such replacement can be accomplished through the use of a number of different and simple tools. Effectively, the replacement occurs through the stripping out of the extrusion and replacement of the same.

Described in detail in the paragraphs following the description of the Camarota Application, is the use of one or more components which can be characterized as "reflectance members." These components are also characterized as "wings," "shutter sections," and/or "canopies." The reflectance members can be positioned laterally on one side of the channel. Alternatively, a double configuration of the reflectance members can also be utilized, where the reflectance member components are appended one to each of opposing sides of the extruded channel. Cylindrical pivots can be utilized for this purpose. With the use of the reflectance members, an advantageous effect is produced, whereby a variable "aperture of reflectance" is provided. This variable reflectance (dependent upon the number and spatial positioning of the reflectance members) substantially influences the light output from the LEDs associated with the flexible LED tape lights. Still further, the reflectance members, with the capability of positional variations, allow the light output to be concentrated and directed in a manner so as to allow the installer to concentrate and direct light output as desired. For example, the maximum intensity of light output can be directed, through the use of the reflectance members, so as to allow this output to be positioned, for example, beneath or behind the LED light assembly itself. From an experimental and physical realizations of prototypes of embodiments of the current invention, test results indicate that light output may be of an intensity utilizing the afore-described techniques so as to make LED light assemblies in accordance with the invention sufficient so as to provide a direct replacement for standard fluorescent T5 and T8 bulbs commonly used in the environment.

Further embodiments directed to light intensity variations, both positional and quantitative, are currently under development. For example, light assemblies in accordance with the invention may include a fixed reflectance member on one side of the channel, with a variably angled reflectance member on the other side of the channel. In addition, embodiments of the invention include structures where a tape light channel may be positioned at a fixed angular relationship with the mounting surface for the tape light. In this manner, it is possible to direct the concentrated center output from the LEDs, while still providing for aperture control of the reflectance members.

As earlier stated, the principles of the invention are disclosed in FIGS. 22-47, along with the written description herein. However, for purposes of complete and adequate disclosure of the current structure and operating principles of the current invention, the general concepts associated with the Camarota Application invention will first be described herein, with reference to FIGS. 1-21. Again, however, it should be emphasized that the Camarota Application inventions are directed in part to the use of diffusion principles for purposes of providing uniformity of light intensity, including the concept of illumination of hot spots for LED linear lights.

Turning to the diffused flexible LED linear light assembly 100, and with reference first to FIGS. 1-7, the diffused flexible LED linear light assembly 100 includes what can be characterized as a flexible LED linear light component 102. The basic design of a flexible LED linear light comprises a series of electrically connected LEDs mounted on a flexible printed circuit board (or "PCB"). In addition to the flexible PCB, the flexible LED linear light also includes a flexible translucent housing or lens which encases the flexible LED linear light printed circuit board.

Figure 20:
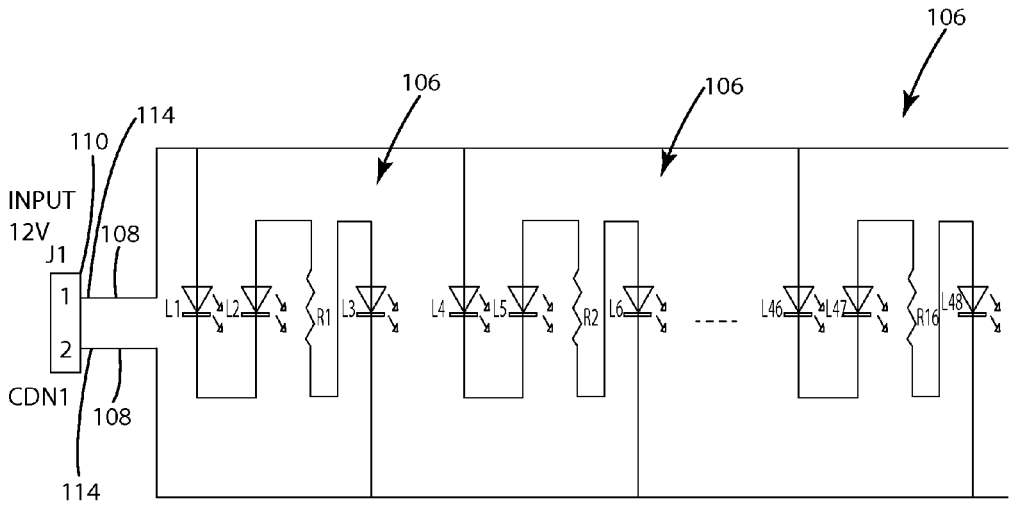
FIG. 20 is a partial schematic drawing illustrating several of the LED elements and their circuit connections to an external power source, as they are associated with the flexible LED linear light.
Figure 21:
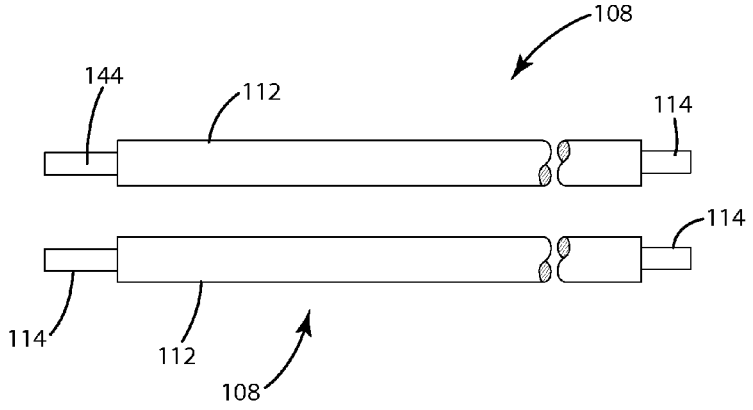
FIG. 21 is an enlarged view of the electrical pigtails shown in FIG. 6, which electrically connect the flexible LED linear light to an external power source.
Figure 22:
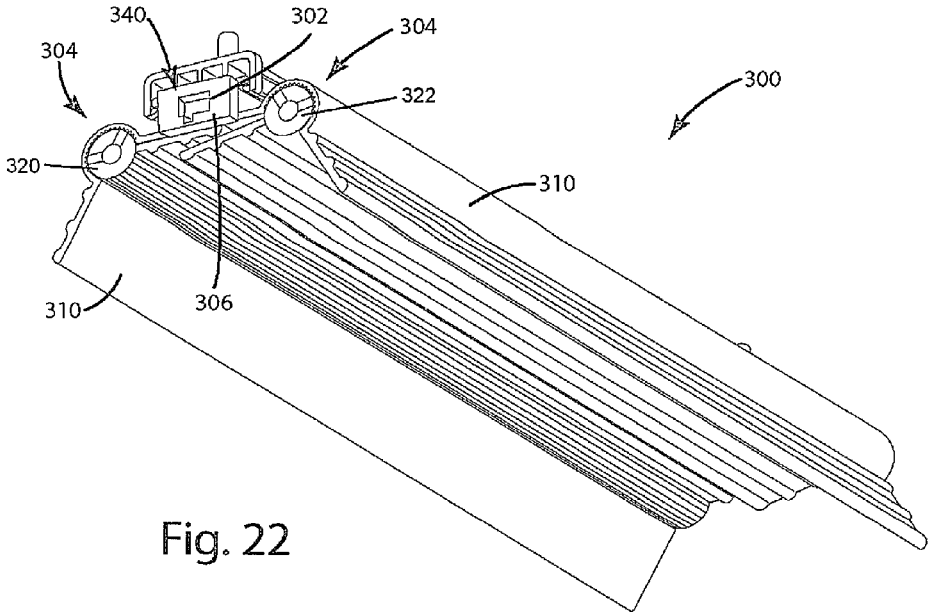
FIG. 22 is a perspective view of a flexible tape light assembly in accordance with the invention, with the light assembly employing a pair of reflectance members and a double row of flexible tape pressed into channels within extruded tracts of the assembly.

The flexible LED linear light component 102 illustrated in the drawings comprises an elongated and generally rectangular flexible base 104, with individual LEDs 106 spaced longitudinally along the elongated direction of the component 102. Each of the LEDs is in the form of a conventional diode configuration. FIG. 20 is a simplified schematic diagram of the circuitry of the LEDs 106. If desired, the LEDs 106 may include a flexible polymer-based PCB, where the LEDs 106 are mounted on the base 104 for a relatively low profile design and small, but efficient size. The base 104 and LEDs 106 may be manufactured in various lengths and widths, so as to accommodate the desired height and sizing of the flexible LED linear light assembly 100.

Figure 5:
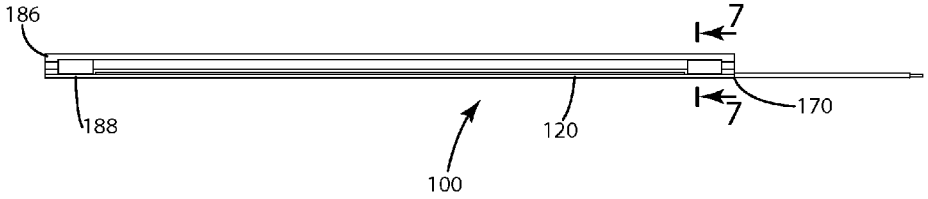
FIG. 5 is a plan elevation view of the diffused flexible LED linear light assembly illustrated in FIGS. 1-4.
Figure 6:
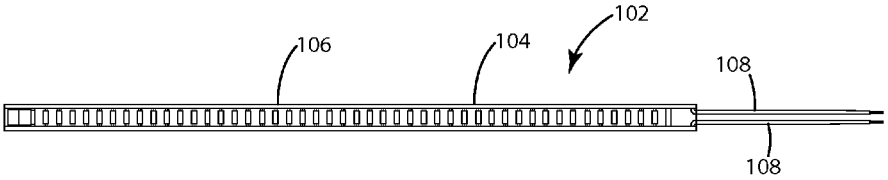
FIG. 6 is a partial plan view of the diffused flexible LED linear light assembly shown in FIG. 5, but specifically showing the flexible LED linear light, individual LEDs, and connector cables to an external power source.

In addition to the base 104 and the LEDs 106, the flexible LED linear light component 102 can also be characterized as including or otherwise being connected to a pair of electrical connectors, commonly referred to as "pigtails." The electrical pigtails utilized with the light assembly 100 are illustrated as they are connected to the flexible LED linear light component 102 in FIGS. 5 and 6. These pigtails are also primarily functionally shown in FIG. 20 as being interconnected between the LEDs 106 and an external source of electrical power 110. In addition, the electrical pigtails 108 are expressly shown in a stand-alone configuration in FIG. 21. Each of the pigtails 108 is shown as having a protective cable or sheath 112 surrounding and encasing conductive wires of connectors 114. The portion of the conductive wires 114 which are exposed are formed by "stripping back" the cable sheaths 112 from the wires 114. One end of the wires 114 will be connected to one end of the string of LEDs 106 through the base 104. The other ends of the conductive wires 114 will be connected to the external source for electrical power 110 shown in FIG. 20. As an alternative, a miniature surface mounted connector could also be utilized as a means to provide the electrical connection, should the need arise.

In addition to the LED tape component 102 and the electrical pigtails 108, the diffused flexible LED linear light assembly 100 further comprises a partially translucent housing 120 which is utilized to house and encase the flexible LED linear light component 102, as well as one set of ends of the electrical pigtails 108. The "partially translucent housing" 120 will be referred to herein as the "translucent housing." In addition to housing and encasing the flexible LED linear light component 102 and one set of ends of the electrical pigtails 108, the translucent housing 120 also serves to function as a partially translucent lens for the light emitted from the LEDs 106 of the flexible LED linear light component 102. Still further, the translucent housing 120 functions so as to exhibit a certain level of diffusion of the light emitted from the LEDs 106. The overall shape and structure of the translucent housing 120 is shown in various figures of the drawing, including FIGS. 1, 2, 4, 5, 7 and 17-19. The translucent housing can be constructed of a number of different materials, including a flexible polymer such as silicone 535U.

With reference particularly to FIGS. 2, 4, 7 and 19, the translucent housing 120 comprises one "side" which can be characterized as a flat base section 122. The flat base section 122 can be of an opaque formulation and, given the positioning of the LEDs 106, does not exhibit any translucent properties. With reference to the positioning shown in FIG. 4 in cross-sectional configuration, extending upwardly from both sides of the flat base section 122 is a translucent curved section 124. The curved section 124, along with the base section 122, completes a lateral enclosure of the flexible LED linear light component 122.

Figure 4:
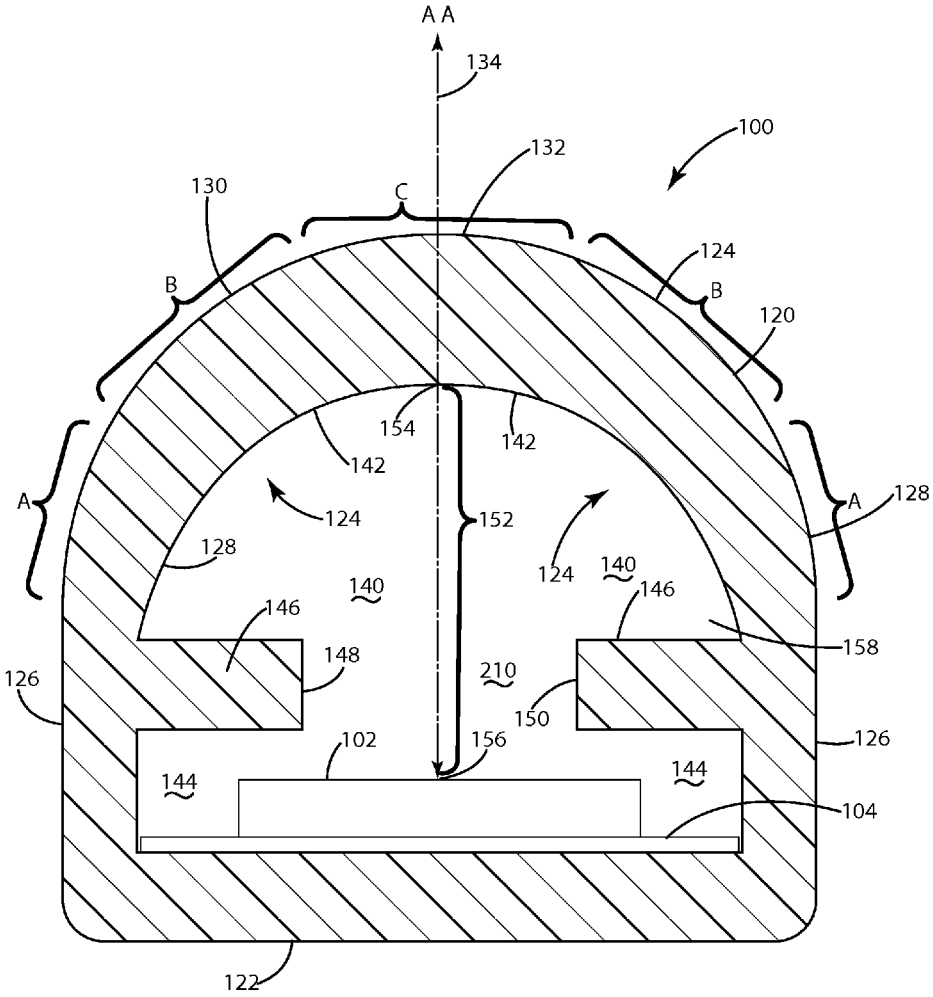
FIG. 4 is an end view of the translucent housing structure, with the flexible LED linear light positioned therein, and specifically showing the variation in the thickness of the translucent portion of the housing structure in a cross-section taken along an axial direction.

The curved arcuate section 124 of the translucent housing 120 varies in thickness (in a cross-sectional configuration) in its lateral surfaces. The variation in thicknesses along the curved section 124 is particularly shown in FIGS. 4, 7 and 19. For purposes of description of these thickness variations, FIG. 4 shows the curved arcuate section 124 as being divided among various segments along the housing 120. Specifically, FIG. 4 first shows a pair of base connecting segments 126, which could be characterized as being connected to or otherwise integral with the ends of the flat base section 122 and depending upwardly (as viewed in FIG. 4) therefrom. These base connecting segments 126 can be relatively constant with respect to thickness. Again with respect to the viewing direction of FIG. 4, extending upwardly from the base connecting segments 126 are segments 128. The segments 128 are illustrated on FIG. 4 as extending along the outer surface of the housing 120 for a distance A. As further shown in FIG. 4, the thicknesses of the segments 128 vary and increase from the upper portion of the base connecting segments 126 to what is shown in FIG. 4 as the upper portions of segments 128. For purposes of the description, the average thickness of each of the segments 128 can be characterized as thickness X. The segment 128 shown on the left side of FIG. 4 can essentially be a mirror image of the segment 128 shown on the right side of FIG.

4. Accordingly, each of these segments 128 has a length along the housing surface of A, with an average thickness of X. Again, it is emphasized that the references to these various segments and thicknesses are solely for purposes of description, and the actual translucent housings 120 do not necessarily have any structural differentiation among these segments, other than the relative relationships with respect to housing thicknesses.

Extending upwardly from the top of each of the segments 128 are further segments which can be characterized as segments 130. As again shown in FIG. 4, the segments 130 extend upwardly along the curved arcuate section 124 of the housing 120, and are illustrated in FIG. 4 as having a segment length B. Again for purposes of the description, the average thickness along the length B of the segments 130 can be characterized as thickness Y. The average thickness Y of the segments 130 can be greater than the average thickness X of the segments 128.

Continuing with reference to FIG. 4, the translucent curved arcuate section 124 of the translucent housing 120 includes a segment 132 which extends upwardly from the upper portions of segments 130 and interfaces with each of the upper portions of segments 130. The segment 132, consisting of the "uppermost" portion of the translucent housing 120, is shown in FIG. 4 as having a length C along the surface of the housing 120. The segment 132 can be characterized as having an average thickness Z. The average thickness Z can be greater than the average thickness Y which, in turn, was previously described herein as being greater than the average thickness X.

Figure 7:
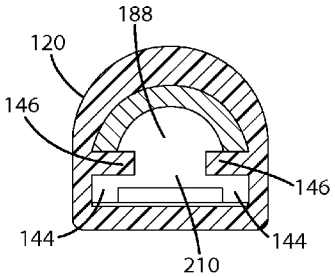
FIG. 7 is a sectional end view of the diffused flexible LED linear light assembly shown in FIG. 5, taken along section lines 7-7 of FIG. 5.

The LEDs 106 and the elongated base 104 are positioned within the interior of the translucent housing 120 as particularly shown in several of the drawings, including FIGS. 1 and 7. With this configuration, and assuming that the thickness of the translucent section 124 of the housing 120 was uniform along its circumference in the axial direction, the intensity of the light transmitted to the interior surface of the translucent section 124 would be greatest at the center of segment C, corresponding to a direction to which is perpendicular to the transmitting plane of each of the LEDs 106. That is, the intensity of the light of the LEDs 106 as it impinges on the interior surface of the translucent section 124 is greatest along what is shown as axis AA, or axis 134 in FIG. 4. Further, in accord with this same concept, the photometric profile of each of the LEDs 106 will typically form a bell-shaped array which is centered along axis AA and will be of an approximately 120 degree included angle. That is, as the angle of the LED light rays moves away from the perpendicular angle formed by axis AA (i.e., the light ray angle moves from the area of segment C to the areas of segments B and A), the natural light intensity of each of the LEDs 106 will decrease. This can result in a significant disadvantage with respect to the aesthetics of the resultant light distribution outside of the flexible LED linear light assembly. Further, to the extent that the flexible LED linear light assembly 100 is being used in a functional manner so as to provide light for a practical purpose, the drop off of light intensity away from axis AA also is a significant disadvantage.

To overcome these problems, the translucent housing 120, as particularly shown in FIGS. 4 and 7, is constructed with the thickness of the housing 120 varying along the areas corresponding to segments A, B and C. Preferably, the thickness variation curve is relatively "smooth" and "steps" or other irregularities in the photometric profile curve are not exhibited. In accordance with the foregoing, the average thickness Z of segment C shown in FIG. 4 will be greater than the average thickness Y of each of the segments B. Correspondingly, the segments A will have an average thickness X which is less than the average thickness Y and the average thickness Z. By appropriately varying the foregoing thicknesses of the translucent housing 120 in cross section, a higher percentage of light transmission through the body of the translucent housing will occur within segments A, as compared to the percentage of light transmission allowed to pass through the translucent housing 120 at the locations of segments B. In turn, the percentage of light transmission allowed to pass through the translucent housing 120 in the areas of segment C will be less in percentage than the percentages of transmission in segments B and A. With these differences in the percentages of light transmission through the thicknesses of housing 120, it is therefore possible to generate and provide for a uniform intensity of the LED light output throughout the transmission area corresponding to the 120 degree included angle. That is, it has been found that by varying the thickness of the housing 120 in cross section, higher percentages of light transmission in areas having the relatively "weakest" LED output strength is achieved. The light output can then be generated with a strength which causes the output to be substantially "even" or "constant" in a circumferential direction, along the axial direction of the flexible LED linear light component 102.

To achieve an appropriate uniformity of light intensity along the axial length of the translucent housing 120, reference is made to the interior structure of the area encased by the translucent housing 120. This area is illustrated in FIG. 4 as interior 140. This interior 140 can be characterized as having an "interior height IH" as also shown in FIG. 4. This interior height IH, which is also characterized as interior height 152, extends from what could be characterized as the LED base level 156 which essentially exists on the same level as the uppermost lens portion of each of the LEDs 106. This interior height IH then extends upwardly in a perpendicular direction relative to the plane of the LEDs 106, to the interior apex 154. This interior apex 154 can be characterized as the uppermost position of an inner surface 142 of the translucent housing 120. The open interior 140 is filled with air or a silicone gel 158, again as shown in FIG. 4. If the interior height IH is of a sufficient value, and assuming that the contours of an inner surface 142 have a curvature substantially corresponding to the curvature shown in FIG. 4, a significant change in "transmissibility" from the air or silicone gel to the translucent housing material will be existent. Further, with the sufficiency of the interior height IH, and appropriate positioning of adjacent LEDs 106, the intersecting ray patterns from the adjacent LEDs can combine and interfere with each other. That is, under these appropriate circumstances, the ray patterns can cause both combination and interference of the light rays. Interference is well known and is a phenomenon in which two rays will superimpose and form a further resultant wave of greater or lower amplitude. This type of interference usually refers to the interaction of waves that are correlated or coherent with each other, either because they came from the same source or, as in this case, because they have the same or nearly the same frequency. Such intersecting ray patterns readily form combining waves. With the appropriate dimensions regarding interior height IH and the spacing of the individual LEDs 106, the resultant intersecting ray patterns from the adjacent LEDs can combine and interfere prior to hitting the inner surface 142 of the translucent housing 120. In accordance with all of the foregoing, the change in transmissibility from the air or silicone to the housing material, plus the light scattering occurring through reflection and transmission will cause the diffusion pattern of the light to be extremely even or constant across the axial length of the LED component. With this phenomena occurring, the diffusion pattern is extremely even or constant across the entirety of the axial length of the LED stream. This occurrence virtually eliminates the well-known "hot spots" which are often created by individual LEDs which are used in strips where there are relatively small distances between the LEDs without the gap or open interior 140 formed by the appropriate dimensions and the use of air or silicone gel as a "fill" for the interior of the translucent housing 120.

Turning to other aspects of the diffused flexible LED linear light assembly 100, the assembly 100 further includes a pair of end caps, comprising an end cap lead end 170 and an end cap trailing end 190. The end cap 170 is illustrated in FIGS. 1, 3 and 5-7 in combination with the translucent housing 120. Further, the end cap 170 is shown in detail in a stand-alone configuration in FIGS. 8, 9 and 10. Correspondingly, the end cap trailing end 190 is shown in detail in a stand-alone configuration in FIGS. 11-16. The end caps 170 and 190 are fitted on the ends of the translucent housing 120, and are used to enclose and encase the flexible LED linear light component 102 within the lower portion of the interior 140 of the housing 120. Further, the trailing end end cap 190 includes means for permitting the electrical pigtails 108 to be received through the end cap 190 for providing electrical power between the external source 110 and the flexible LED linear light component 102.

Figure 8:
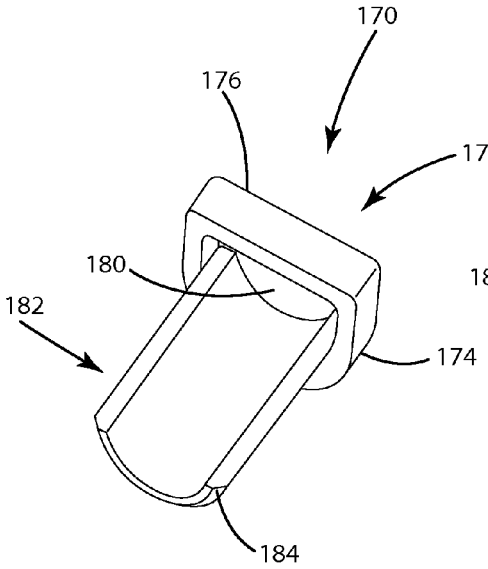
Figure 9:
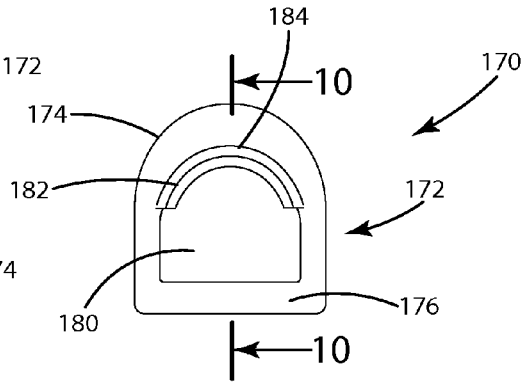
Figure 10:
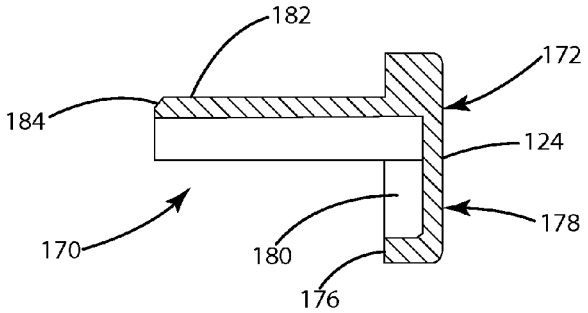
FIG. 10 is a sectional, side view of the end cap lead in shown in FIG. 9, taken along section lines 10-10 of FIG. 9.
Figure 11:
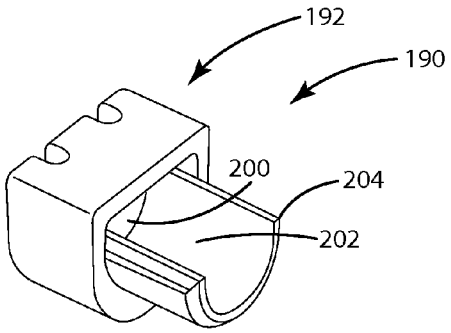
FIG. 11 is an underside perspective view of the end cap trailing end of the diffused flexible LED linear light assembly shown in FIGS. 1-4.
Figure 12:
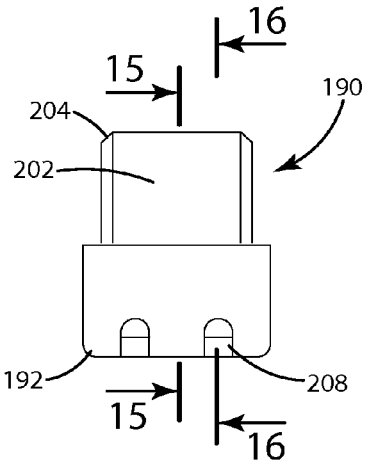
FIG. 12 is an underside elevation view of the end cap trailing end shown in FIG. 11.
Figure 13:
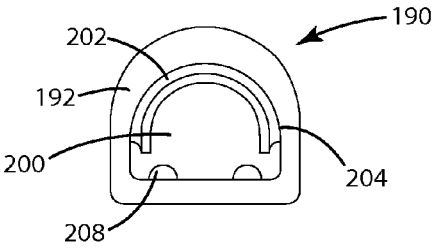
FIG. 13 is an end, elevation view of the end cap trailing end shown in FIG. 11.
Figure 14:
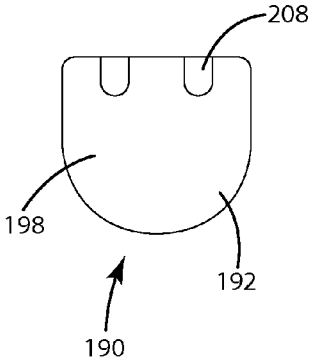
FIG. 14 is an end view of the end cap trailing end shown in FIG. 11, as viewed from the exterior of the diffused flexible LED linear light assembly, and as further shown in an upside down configuration.
Figure 15:
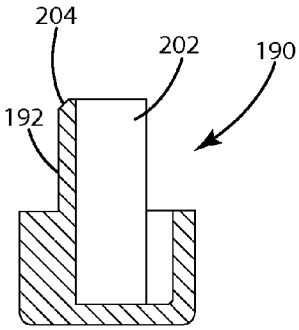
FIG. 15 is a sectional, side view of a portion of the end cap trailing end shown in FIG. 12, and taken along section lines 15-15 of FIG. 12.
Figure 16:
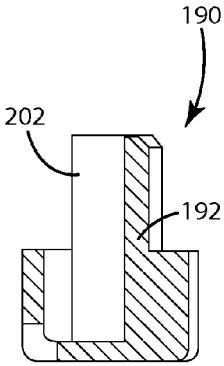
FIG. 16 is a further side, sectional view of the trailing end end cap shown in FIG. 12, taken along section lines 16-16 of FIG. 12, and effectively showing a side, sectional view of the end cap trailing end from an opposing direction of the side, sectional view shown in FIG. 15.
Figure 17:
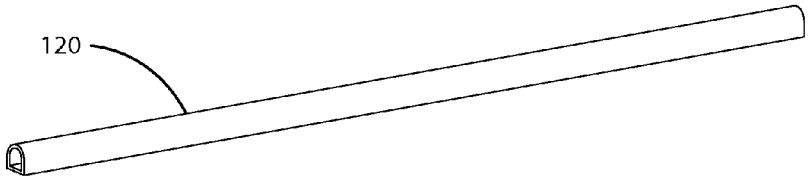
FIG. 17 is a perspective view of the translucent housing of the diffused flexible LED linear light assembly as shown in FIGS. 1-4.
Figure 18:
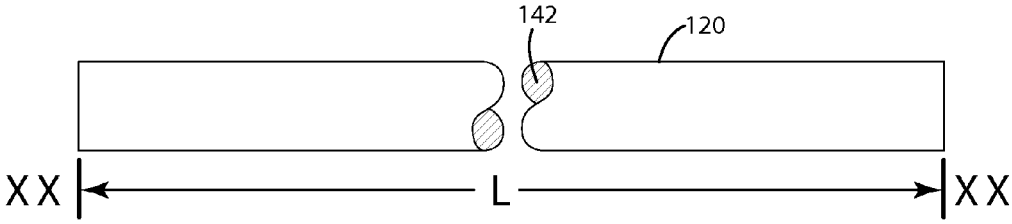
FIG. 18 is a side, elevation view of the translucent housing shown in FIG. 18.
Figure 19:
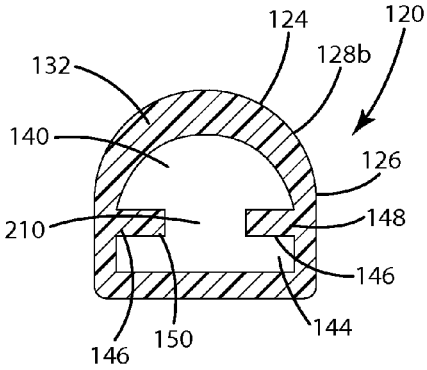
FIG. 19 is a sectional, end view of the translucent housing shown in FIG. 18.

Turning first to the end cap lead end 170 and with specific reference to FIGS. 8, 9 and 10, the end cap 170 provides a sealed connection with the translucent housing 120. The end cap 170 includes an outer body 172, as primarily shown in FIGS. 8 and 9. As particularly shown in FIG. 9, the outer body 172 includes a curved section 174 and a lower flat section 176. The section 174 and section 176 are preferably integral with each other. The outer body 172 is sized and configured so as to essentially "match" the cross sectional configuration of the translucent housing 120. With respect to the outer body 172, the body 172 comprises an outer face 178, primarily shown partially in FIG. 3 and in FIG. 10. On an opposing side of the outer face 178, the outer body 172 includes a hollow interior area 180, again shown primarily in FIGS. 8, 9 and 10.

The end cap 170 further includes an inner projection 182. The inner projection 182 is shown in FIGS. 8 and 9, and also shown in the sectional view of FIG. 10. The inner projection 182, as apparent from the drawings, is of an arcuate shape with a partially beveled end 184 at the terminal portion of the projection 182. The inner projection 182 is sized and configured so as to be received within the curved or arcuate section 124 of the translucent housing 120. In fact, the translucent housing 120 and the end cap 170 are particularly sized and configured so that the inner projection 182 abuts the inner surface 142 of the housing 120. This configuration is particularly shown in FIG. 7. With reference to both FIGS. 5 and 7, the end cap 170 is sealed with the translucent housing 120 through the use of an adhesive 186. The adhesive 186 can be any of a number of commercially available adhesives suitable for bonding the materials. Also, glues or similar sealing agents, which are preferably water resistant and UV-stable can be utilized. For further sealing of the end cap 170 to the translucent housing 120, coating material 188 having a silicone base (see FIGS. 5 and 7) can be utilized. With this configuration, and again with the appropriate sizing of the various elements, the end cap 170 is secured to the translucent housing 120 in a manner so that the end cap 170 mounts flush with the outer surface of the translucent housing profile. This configuration is in contrast to one where a "step" or other discontinuity is formed, which would occur if the end cap 170 was located "outside" of the profile of the translucent housing 120. This flush-type configuration between the translucent housing 120 and an end cap is particularly shown in FIG. 1 with respect to the translucent housing 120 and the end cap trailing end 190. With this configuration utilizing the inner projection 182 and providing for a flush mounting between the end cap 170 and the translucent housing 120, the mounting of the end cap 170 is facilitated and made easier for the assembler. In addition, the aesthetics of the overall diffused flexible LED linear light assembly 100 are significantly improved, relative to a configuration where the end cap is not flush mounted with the housing.

The end cap trailing end 190 will now be described, primarily with respect to FIGS. 1, 3, 5, 7 and 11-16. It should be noted that the trailing end end cap 190 is substantially similar in size and construction to the end cap lead end 170, but with certain additional elements primarily related to providing means for receiving the electrical pigtails 108. More specifically, the end cap 190, like the end cap 170, includes an outer body 192, as primarily shown in FIGS. 11, 12, 15 and 16. As particularly shown in FIG. 11, the outer body 192 includes a curved section 194 and a lower flat section 196. The section 194 and section 196 are preferably integral with each other. Of particular importance, the outer body 192 is sized and configured so as to essentially "match" the cross-sectional configuration of the translucent housing 120. With respect to the outer body 192, the body 192 comprises an outer face 198, primarily shown in FIGS. 1 and 14. On an opposing side of the outer face 198, the outer body 192 includes a hollow interior area 200, primarily shown in FIGS. 3, 11 and 13.

Similar to the end cap lead end 170, the end cap 190 further includes an inner projection 202. The inner projection 202 is particularly shown in FIGS. 3, 11-13 and 16. The inner projection 202, as apparent from the drawings, is of an arcuate shape with a partially beveled end 204 at the terminal portion of the projection 202. The inner projection 202 is sized and configured so as to be received within the curved or arcuate section 124 of the translucent housing 120. In fact, the translucent housing 120 and the end cap 190 are particularly sized and configured so that the inner projection 202 abuts the inner surface 142 of the housing 120. This configuration is shown in FIG. 7. With reference to both FIGS. 5 and 7, the end cap 190 is preferably sealed with the translucent housing 120 through the use of the adhesive 186 previously described with respect to end cap 170. For a further sealing of the end cap 190 to the translucent housing, coating material 188 having a silicone base (see FIGS. 5 and 7) can be utilized. With this configuration, and again with the appropriate sizing of the various elements, the end cap 190 is secured to the translucent housing in a manner so that the end cap 190 mounts flush with the outer surface of the translucent housing profile. This configuration is in contrast to one where a "step" or other discontinuity is formed, which would occur if the end cap 190 was located "outside" of the profile of the translucent housing 120. This flush-type configuration between the translucent housing and the end cap 190 is particularly shown in FIG. 1. With this configuration utilizing the inner projection 202 and providing for a flush mounting between the end cap 190 and the translucent housing 120, the mounting of the end cap 190 is facilitated and made easier for the assembler. In addition, the aesthetics of the overall diffused flexible LED linear light assembly 100 are significantly improved, relative to a configuration where the end cap is not flush mounted with the housing.

As earlier stated, the end cap trailing at 190 is substantially similar to the end cap lead end 170. One distinction relates to the end cap 190 having means for receiving elements for connecting the flexible LED linear light component 102 to the previously described external source of electrical power 110. Specifically, and as particularly shown in FIGS. 1, 3, and 11-16, the end cap trailing end 190 includes a pair of connection apertures 208. The connection apertures 208 are utilized to receive the electrical pigtails 108 which were previously described herein with respect to FIG. 20, and provide components for purposes of transmitting electrical power from the external source of electrical power 110 to the flexible LED linear light component 102. These connection apertures 208 are not an absolute necessity for the end cap lead end 170, but could be provided if required for purposes of "stringing together" a number of flexible LED linear light assemblies 100.

As previously described, the translucent housing 120 includes an open interior area 140, as shown, for example, in FIGS. 2, 4, 7 and 19. Below the open interior area 140 is an area within the translucent housing 120 which is illustrated to in the drawings as hidden area 144. This hidden area 144 is also shown in FIGS. 2, 4, 7 and 19. The open interior area 140 and the hidden area 144 are formed and separated by a pair of inwardly directed projections 146. These inwardly directed projections 146 are formed integrally with the translucent housing 120 as the lower portion of the translucent curved or arcuate section 124. These projections 146 are shown as the first inner projection 148 and second inner projection 150. These inner projections form a channel 210 which separates the open interior area 140 from the hidden area 144. By adding the channel 210 formed by the inwardly directed projections 146, and by locating the projections on the bottom inside portion of the translucent housing 120, it is then possible to locate the flexible LED linear light component 102 securely against the bottom of the flat base section 122.

To form the translucent housing 120 with the inwardly directed projections 146, a method of manufacture is utilized whereby the flexible LED linear light component 102 is essentially "pulled" through an extrusion of the translucent housing material. As earlier stated, the channel formed by the projections 146 provides the capability of locating the flexible LED linear light component 102 on the bottom portion of the housing 120. This method of manufacture facilitates assembly, while also "setting" the geometry for a successful air or silicone gel filled gap as described in previous paragraphs.

As earlier described, the Camarota Application discloses a substantial advance in certain technology related to linear flexible tape light assemblies. These advances have been disclosed herein in the prior paragraphs with respect to FIGS. 1-21. The current invention to which this applicable is specifically directed presents additional advances in the art of LED lighting assemblies. Further, the inventions covered by the current application are directed to solutions of technical problems somewhat distinct from those associated with the previously described light assemblies from the Camarota Application.

Turning now to the specific inventions to which this application is directed, various embodiments of shelf light assemblies with optional reflectance members are described in the following paragraphs, and illustrated in FIGS. 22-47. It can be noted that the "light engine" utilized in the Camarota Application and previously described herein with respect to FIGS. 1-21 has substantial similarities to the light engine which may be utilized with the current invention. However, the overall structure of the shelf lights in accordance with the invention include substantial differences from the disclosure of the Camarota Application. A principal concept associated with the Camarota Application relates to the light generated with the Camarota Application invention being diffused. In contrast, light generated by the LED assemblies with the current invention does not require any linear light diffusion. Accordingly, an extruded LED encasement sleeve utilized with the current invention can be rectangular in shape, as opposed to being domed. Also, the encasement sleeve can be constructed of clear material.

Expressly stated, certain concepts of the current invention are directed at the production of an encapsulated light produce that will pass the maximum amount of light for certain applications, such as refrigerated and non-refrigerated cabinetry. Light assemblies in accordance with the invention will not typically be utilized in situations where there is a direct viewing of the light. Accordingly, issues associated with hot spots and dark zones are not particularly relevant, and diffusion techniques do not have to be utilized for the light emanating from the LEDs of the shelf lights with optional reflectance members.

In accordance with other aspects of the invention, a method of manufacture, utilizing internal ribs, can be employed. This manufacturing method substantially corresponds to the methods utilized in the Camarota Application.

Also in accordance with certain aspects of the invention, a flexible tape LED array is utilized to provide the LED lighting itself. An advantage of such a flexible tape LED array structure is the relatively low cost. The flexible tape LED arrays can be supported within aluminum tracks. The arrays are replaceable within the tracks, without replacement required of any substantial portion or other elements of the light assembly. Also, replacement can be accomplished through the use of varying and relatively simplistic tools. The replacement essentially requires the stripping out of the extrusion and replacement of the same.

In accordance with certain principal concepts of the invention, linear lights in accordance with the invention utilize what can be characterized as "reflectance members." These reflectance members can be positioned laterally on one side of the channel. Alternatively, a double configuration of the reflectance members can also be utilized, where the reflectance member components are appended one to each of opposing sides of the extruded channel. To provide for this construction, cylindrical pivots can be utilized. With the reflectance members, an advantageous effect is produced, which is characterized as a variable "aperture of reflectance." This variable reflectance (which will be dependent on the number and spatial positioning of the reflectance members) substantially influences the light output from the LEDs associated with the flexible LED tape lights. Also, the reflectance members, with the capability of positional variations, allows the installer to concentrate and direct light output as desired. As an example, maximum intensity of light output can be directed, through the use of the reflectance members, so as to allow the output to be positioned, for example, beneath or behind the LED light assembly itself. In an experimental and physical realization of prototypes of embodiments of the current invention, test results indicate that the light output may be of an intensity utilizing the aforedescribed techniques, so as to make LED light assemblies in accordance with the invention sufficient to provide a direct replacement for standard fluorescent T5 and T8 bulbs commonly used in the environment. Other reflectance member structures can be utilized, without departing from the principal concepts of the invention. For example, light assemblies in accordance with the invention may include a fixed reflectance member on one side with a variably angled reflectance member on the other side of the channel. In addition, embodiments of the invention can include structures where a tape light channel may be positioned at a fixed angular relationship, with the mounting surface for the tape light. In this manner, it is possible to direct the concentrated center from the LEDs, while still providing for aperture control of the reflectance members.

The shelf light with optional reflectance members in accordance with the invention can utilize the flexible tape light described in prior paragraphs. However, the light engine, although similar in construction to the previously described linear light system, does not use diffusion properties. Instead, the extruded LED encasement sleeve is rectangular in shape (not domed), and is constructed from clear material. An object of the current invention is to produce an encapsulated product that passes the maximum amount of light for particular applications. Because the light will not be used for direct viewing, the issues primarily associated with "hot spots" are not of primary importance. Still further, the internal ribs used in the method of manufacture on the previously described diffused version, can be retained in the current design in accordance with the invention.

The drawings illustrate a variety of potential configurations utilizing single and double rows (multiple rows) of the tape pressed into channels in extruded tracks.

As shown in the drawings, certain configurations utilize one or two plastic elements appended to the sides of the extrusion through a cylindrical pivot. These reflectance members provide variable apertures of reflectance which have been found to dramatically influence the light output from the LEDs. The concentration and directing of light output places the output in a place where it is desired, namely, beneath or behind the light. The reflectance members can include flexible reflectance members, and can also include rigid fixed reflectance members on one side and variable angled reflectance members on another side. Another embodiment is one that places the tape light channel at a fixed angular relationship with the mounting surface, so as to direct the concentrated center output from the LEDs, and yet is still capable of adding the aperture control of the wing or wings.

Figure 23:
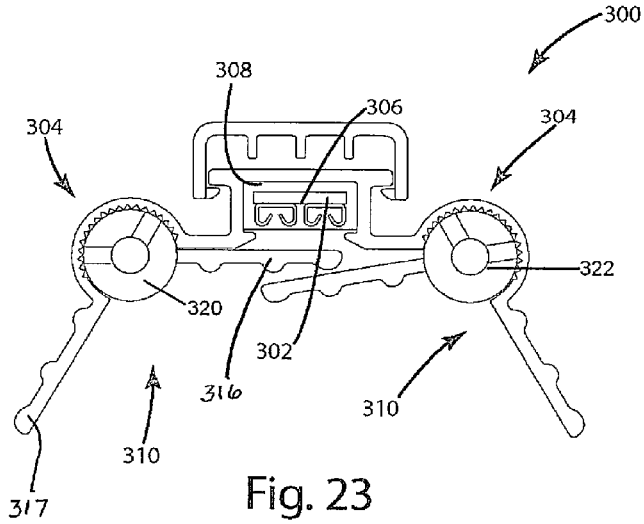
FIG. 23 is an end, elevation view of the flexible light assembly illustrated in FIG. 22, again showing the reflectance members in a double configuration, as well as a double row configuration of the tape light.
Figure 24:
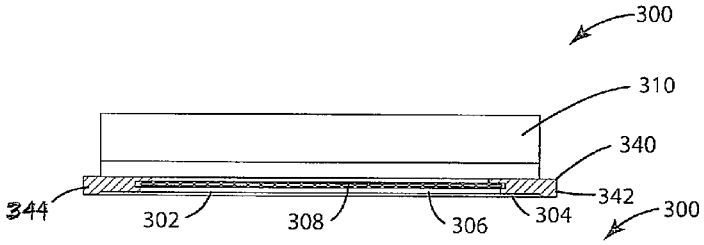
FIG. 24 is a side, elevation view of the light assembly shown in FIG. 22, and showing one of the reflectance members, a pair of end caps, a PCB and LED PCB jacket, along with various other components.
Figure 25:
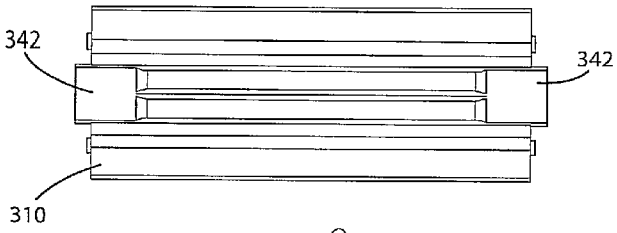
FIG. 25 is a plan view of the double reflectance member light assembly shown in FIG. 24.
Figure 26:
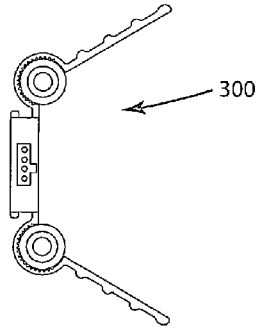
FIG. 26 is an end, elevation view of the double reflectance member light assembly shown in FIGS. 22-25.
Figure 27:
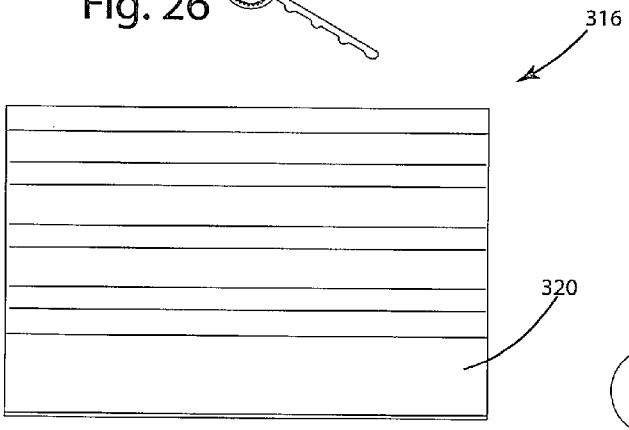
FIG. 27 is a plan, elevation view of an example reflectance member in accordance with the invention, with the reflectance member corresponding to one of the reflectance members shown in FIG. 22, and further shown in a stand-alone configuration.
Figure 28:
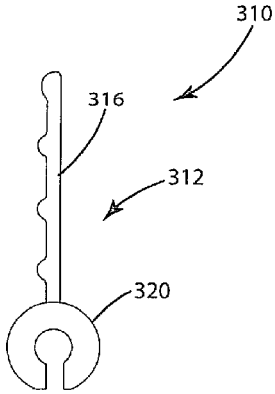
FIG. 28 is an end or side, elevation view of the reflectance member shown in a stand-alone configuration in FIG. 27.
Figure 29:
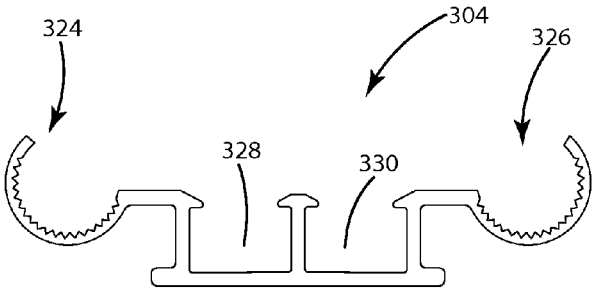
FIG. 29 is an end, elevation view of an example double-channel element which can be utilized with the tape light assembly shown in FIG. 22, with the double-channel element being shown in FIG. 29 in a stand-alone configuration.
Figure 30:
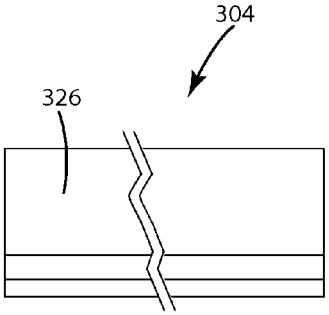
FIG. 30 is a side, elevation view of the double-channel element shown in FIG. 29.
Figure 31:
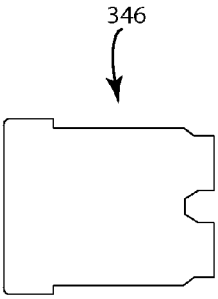
FIG. 31 is a plan, elevation view of an example embodiment of an end cap which could be used with the light assembly shown in FIG. 22, in accordance with the invention.
Figure 32:
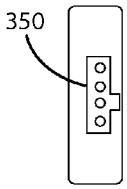
FIG. 32 is an end, elevation view of the outer end of the end cap shown in FIG. 31.
Figure 33:
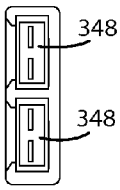
FIG. 33 is an end, elevation view showing an example of an end of the end cap shown in FIG. 31, with the end opposing the end shown in FIG. 32.
Figure 34:
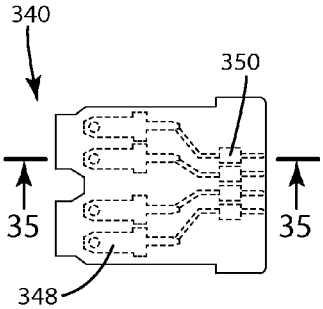
FIG. 34 is partially-schematic and partially-physical drawing of the male terminal and four pin conductor elements which are internal to the end cap shown in FIG. 31.
Figure 35:
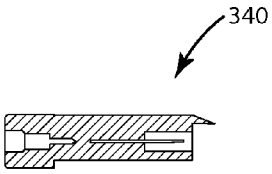
FIG. 35 is a side, sectional view of the end cap shown in FIG. 31, taken along section lines 35-35 of FIG. 34.
Figure 36:
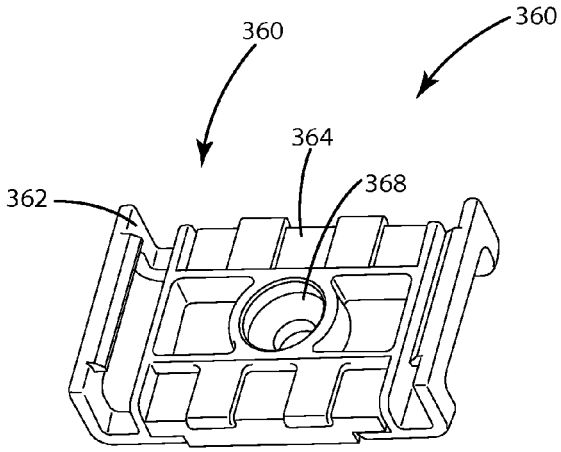
Figure 37:
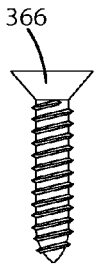

As earlier stated, the principles of the invention are disclosed, by way of example, in shelf light assemblies having optional reflectance members as illustrated in FIGS. 22-47. A first embodiment of a shelf light having an optional reflectance member is illustrated as shelf light 300 in FIGS. 22-26. The shelf light 300 can also be characterized as a canopy light assembly. The double winged shelf light assembly 300 includes what can be characterized as a flexible LED linear light component 302. The basic design of the flexible LED linear light component 102 comprises a series of electrically connected LEDs mounted on a flexible PCB. With reference particularly to FIGS. 23, 24 and 26, the flexible LED light component 302 comprises a double channel 304. The double channel 304 comprises an extruded aluminum track. For the double channel configuration of the shelf light assembly 300, a pair of LED PCBs 308 are mounted within the double channels 304. Each LED PCB 308 is of a flexible structure and can be characterized as utilizing a flexible tape LED array. This concept of the invention is in contrast to a number of prior art manufacturers, where such manufacturers have resorted to utilizing a rigid PCB mounted in its aluminum track, and utilizing a protective lens. The use of a flexible tape array such as the LED PCB 308 is that the arrays become replaceable in the aluminum tracks supporting the same. Further, these tape arrays are relatively inexpensive, and replacement can be accomplished with any of a number of simple tools. The LED PCBs 308 can readily be stripped away from the channels 304 and replaced.

Figure 43:
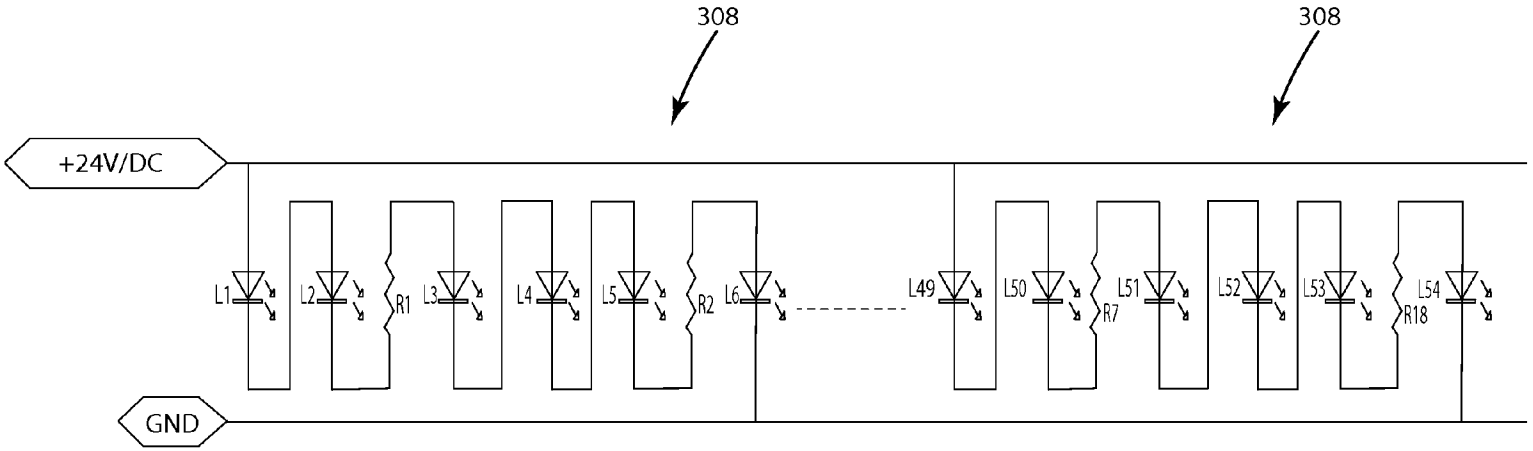
FIG. 43 is a partial schematic drawing illustrating several of the LED elements and their circuit connections, as they are associated with the LED PCB assembly.
Figure 44:
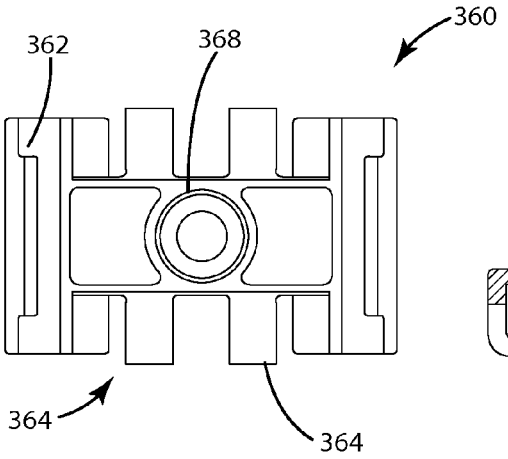
FIG. 44 is a plan view of a clip of mounting kit which can be utilized in accordance with the invention with the shelf light assembly.
Figure 45:
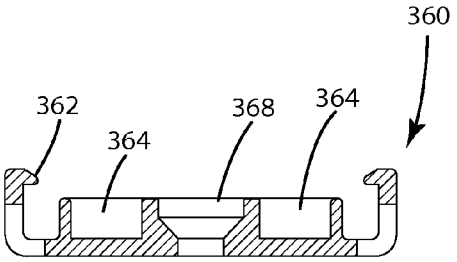
FIG. 45 is an elevation view of the mounting kit shown in FIG. 44.
Figure 46:
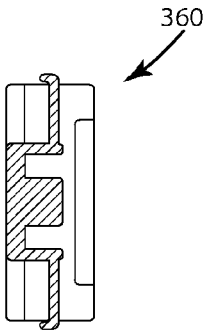
FIG. 46 is a left-side end view of the mounting kit shown in FIG. 44.
Figure 47:
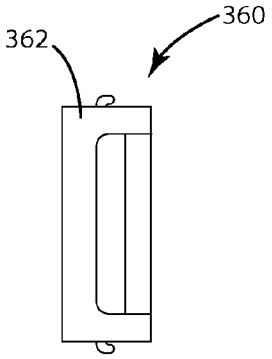
FIG. 47 is a right-side end view of the mounting kit shown in FIG. 44.

In addition to the foregoing components, the double winged shelf light assembly 300 also includes an enclosure which can be characterized as an LED PCB jacket 306. This jacket is particularly shown in FIG. 24. In the previously described Camarota Application, an extruded LED encasement sleeve was domed and utilized varying thicknesses. Such a construction was in part to produce diffusion effects, which are unnecessary with respect to the shelf light assemblies in accordance with the current invention. More specifically, a principal concept of shelf lights in accordance with the current invention relates to production of encapsulated products that will pass the maximum amount of light for particular applications. Because such light will not be applied for direct viewing, the development of hot spots and the like are not a concern. Accordingly, the sleeve or encapsulated LED PCB jacket can be rectangular in shape, and constructed of a uniform thickness, in contrast to the domed and thickness variations of other encapsulated LEDs. Each LED PCB light component can comprise an elongated and generally rectangular flexible base, with individual LEDs spaced longitudinally along the elongated direction of the LED PCB component 308. Each of the LEDs can be in the form of a conventional diode configuration. FIG. 43 is a relatively simplified schematic diagram of the circuitry of an LED PCB 308.

The use of two plastic reflectance member sections appended to the sides of the extrusions through cylindrical pivots is particularly shown in FIGS. 22-25. Therein, the shelf light assembly 300 includes a pair of reflectance members 310 which can extend along the longitudinal length of the shelf light assembly 300 on opposing sides thereof. In the particular embodiment of the shelf light assembly 300, the reflectance member assemblies 310 comprise a first reflectance member assembly 312 and second reflectance member assembly 314, each mounted on opposing sides of the shelf light assembly. The first reflectance member assembly 312 includes a first planar reflectance member 316 having an elongated and flat configuration and a stationary reflectance member 317. The second reflectance member assembly 314 includes a second planar reflectance member 318. The first planar reflectance member 316 is coupled to or is otherwise integral with a first cylindrical pivot coupling 320. Correspondingly, the second planar reflectance member 318 is coupled to or is otherwise integral with a second cylindrical pivot coupling 322. The first reflectance member assembly 312 is illustrated in a stand-alone format in FIGS. 27 and 28.

As earlier stated, the double reflectance member shelf light assembly 300 also includes a double channel 304. The double channel 304 is shown in a number of illustrations, for example, FIGS. 23 and 24. In particular, the double channel 304 is illustrated in a stand-alone configuration in FIGS. 29 and 30. With reference thereto, the double channel 304 comprises a first reflectance member bracket 324 and second reflectance member bracket 326. The first reflectance member bracket 324 is utilized to capture, in a pivotal configuration, the first cylindrical pivot coupling 320. The bracket 324 and pivot coupling 320 can be appropriately constructed so as to permit capture of the coupling 320 in the bracket 324, while still allowing for rotational or pivotal movement of reflectance member 316. The second reflectance member bracket 326 has a substantially identical configuration to that of bracket 324, but is adapted to capture, in a pivotal manner, the second pivot coupling 322. The double channel 304 further comprises a first LED channel passage 328 and a second LED channel passage 330.

The use of the reflectance member assemblies 310 comprises a substantial advance in the art. It should be noted that with the reflectance member assemblies 310 having the capability of positional adjustment of their corresponding reflectance members, they provide for variable apertures of reflectance. Such apertures of reflectance have been found to dramatically influence the light output from the LEDs. More specifically, the reflectance members allow the user to concentrate and direct light output so as to allow the output in the place where it is desired, including positions beneath or behind the light.

Figure 41:
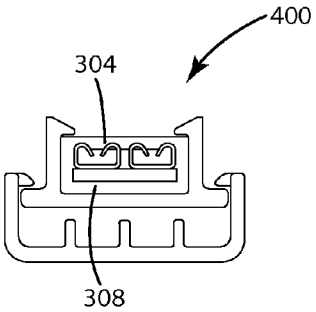
FIG. 41 is an end, elevation view of the reflectance member light assembly illustrated in FIG. 40.

As earlier stated, various reflectance member configurations can be utilized with embodiments of shelf light assemblies in accordance with the invention. For example, the structure shown for the reflectance members with shelf light assembly 300 can be utilized with only a single reflectance member, rather than a pair of the same. Further, in certain situations, it might be desirable to utilize shelf light assemblies in accordance with the invention with an absence of reflectance members. Such a configuration is illustrated in FIG. 41. Further, shelf light assemblies in accordance with the invention may comprise other variations, such as a rigidly fixed reflectance member on one side, while a variable angled reflectance member is positioned on the other side of the light assembly. Still another variant is one which places the tape light channel at a fixed angular relationship with the mounting surface, so as to direct the concentrated center output from the LEDs and yet still be capable of adding the aperture control of the reflectance members.

Certain concepts associated with the shelf light assemblies in accordance with the invention utilize various elements which exist within the inventions covered by the Camarota Application. For example, the light assembly 300 can include a pair of end caps 340. The end cap pair is shown in FIG. 24 as comprising an end cap lead end 342 and an end cap trailing end 344. The end cap lead end 340 is shown in detail in a stand-alone configuration in FIGS. 31-35. Each of the end caps 340 is fitted on an opposing end of the rectangular housing of the shelf light assembly, and are collectively used to enclose and encase the flexible LED PCB assemblies.

Each end cap 340 can include a casing 346. The casing 346 can be utilized in combination with a four pin connector 350 and a male terminal 348. The male terminal 348 extends outwardly in an opposing direction from the four pin connector 350. The end caps are utilized to provide means for permitting electrical components to be received through the end caps for providing electrical power between external sources and the LED PCB light assemblies 102.

In view of the prior description of the Camarota Application and the end caps used therein, the end caps associated with the current invention will not be described in the same level of detail. The end caps 340 can each include inner projections. The inner projections can be of a rectangular or square shape, corresponding to the shape and structure of the overall housing of the shelf light assembly 300. Each end cap 340 can be sealed with the rectangular housing or PCB jacket 306. If desired, the PCB jacket 306 and each end cap 340 are sized and configured so that inner projections abut an inner surface of the PCB jacket 306. The end caps 340 can be sealed with the channel housing through the use of adhesives or the like. Such adhesives can be of a number of commercially available adhesives suitable for bonding the material. Also, glues or similar sealing agents, which are preferably water resistant and UV-stable can be utilized. For further sealing of the end caps 340, coating materials having a silicone base can be utilized. With this configuration, and with the appropriate sizing of the various elements, the end caps 340 can be secured to the housing in a manner so that each is mounted flush with the outer surface of the housing profile. This configuration is in contrast to one where a "step" or other discontinuity is formed, which would occur if the end caps 340 were located "outside" of the profile of the housing. This flush-type configuration between the housing and an end cap facilitates the mounting of the end caps by the assembler. Also, the aesthetics of the overall shelf light assembly are significantly improved.

The end cap 340 associated with the trailing end of the LED light assembly 300 can be substantially similar to the end cap 342 which has previously been described herein and illustrated with respect to the end cap lead end 342. Alternatively, somewhat different configurations can be utilized between the end caps 140 and 342. Such differences are shown with respect to the end caps 170 and 190 utilized with the Camarota Application and described in previous paragraphs herein.

In addition to the components previously described herein, the double reflectance member LED shelf light assembly 300 can include a mounting kit 360. An example of mounting kit 360 is illustrated in FIGS. 36, 37, and 44-47. The mounting kit 360 is utilized to release and secure the shelf light assembly 300 to an external structure. With reference to the drawings, the mounting kit 360 includes a plastic clip 362 which is secured to the shelf light assembly 300 for the use of a slide head screw 366 or similar elements which are received with aperture 368. The clips 362 capture external ribs of the shelf light assembly, and the magnet 364 facilitates securing of the plastic clip 362 to the structure of the light assembly 300.

Other concepts in accordance with the invention relate to methods of manufacture. The extruded LED encasement sleeve is rectangular in shape, and can be constructed from clear material. The internal ribs utilized in the method of manufacture associated with the Camarota Application are also utilized with the manufacturer of the shelf light assemblies in accordance with the current invention.

More specifically, to form the rectangular housing, the flexible LED linear light component is essentially"pulled" through an extrusion of the rectangular housing material. The channels formed by the extruded aluminum provide the capability of locating the flexible LED light components on a bottom portion of the housing. This method of manufacture facilitates assembly, while also "setting" the geometry for the structure.

Figure 38:
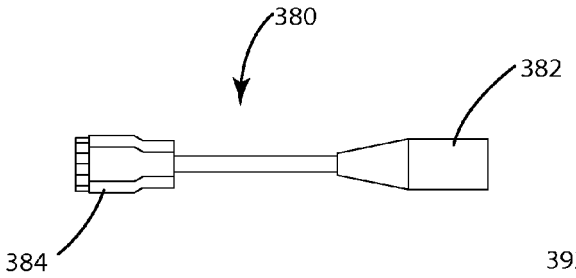
FIG. 38 is a side, elevation view of an example wire jumper which may be utilized with the reflectance member light assembly in accordance with the invention.
Figure 39:
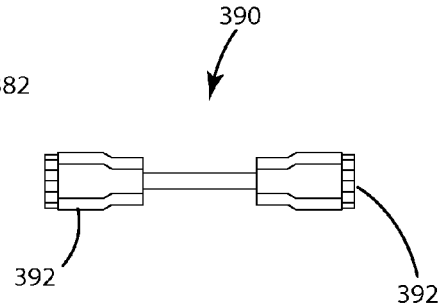
FIG. 39 is a side, elevation view of a wire add on component which can be utilized with the reflectance member light assembly in accordance with the invention.

Other concepts associated with the structure and use of the shelf light assembly in accordance with the invention include the use of coupling components. For example, FIG. 38 illustrates a wire jumper 380 shown as having a G type male connector 382 at one end and a female connector 384 at an opposing end. Correspondingly, FIG. 39 illustrates a wire add on 390 having opposing four pin female connectors 392 at opposing ends. With these associated components, the shelf lights in accordance with the invention can be "daisy chainable" up to predetermined distances based on electrical and structural characteristics of the shelf light components.

As earlier described, the mating or coupling elements can have mating connectors at one end, and then may have, alternatively, a pigtail at the other end or otherwise have an overmolded connector which mates to, for example, a customer's cabinet.

In general, the shelf lights in accordance with the invention utilizing reflectance members will produce light sources that are "tunable" by the adjustable reflectance members. The shelf lights in accordance with the invention can be driven through the use of multiple aluminum boards, employing conventional LEDs. The drive scheme for the light assemblies can be resistive.

Figure 40:
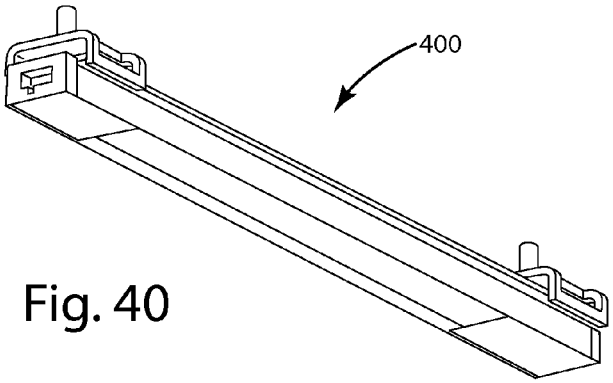
FIG. 40 is a perspective view of a reflectance member light assembly in accordance with the invention, having an absence of reflectance members.
Figure 42:
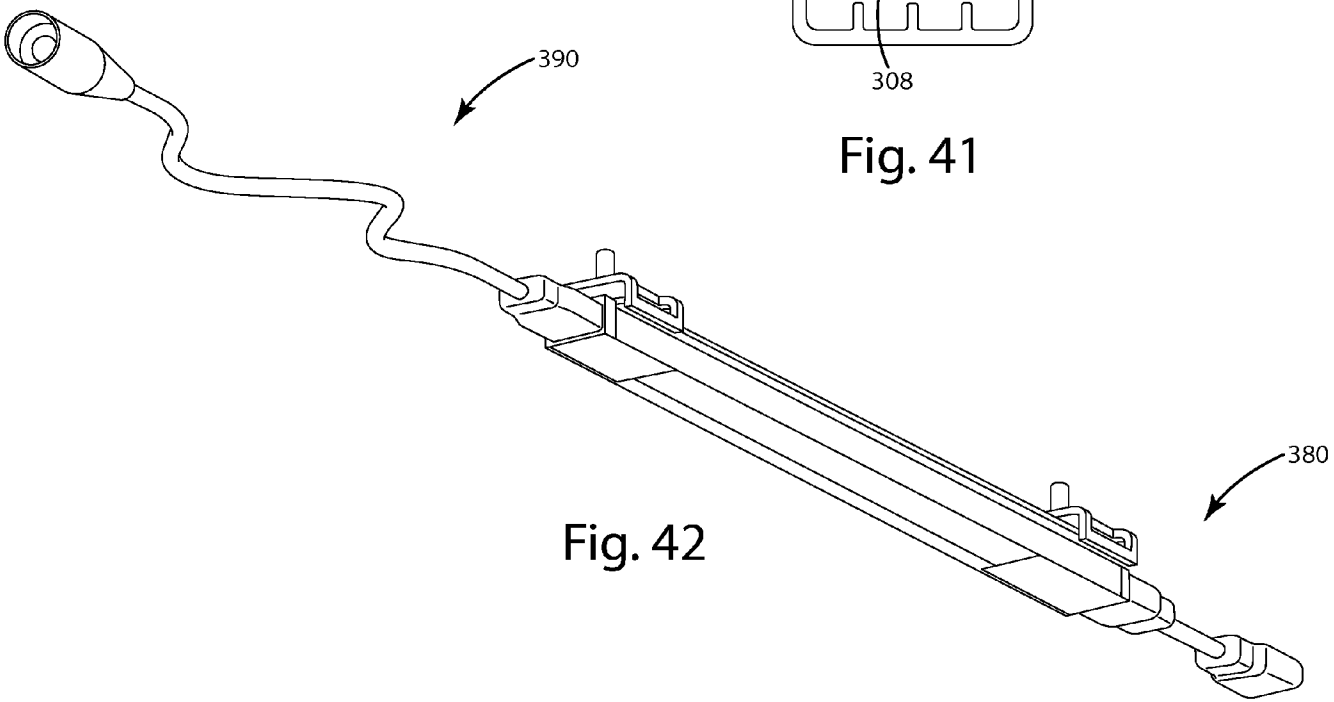
FIG. 42 is a perspective view of the reflectance member light assembly illustrated in FIG. 40, but also showing the light assembly with a wire jumper and a wire add on component connected thereto.

As apparent from the foregoing description, and the drawings, a significant number of variations of shelf light assemblies in accordance with the invention can be achieved, beyond the particular shelf light 300 described in detail herein. For example, FIG. 40 is a perspective view of a reflectance member light assembly 400, having a structure similar to the structure of the light assembly 300, but with an absence of reflectance members. FIG. 41 is an end, elevation view of the light assembly shown in FIG. 40. FIG. 42 is a perspective view of the reflectance member light assembly illustrated in FIG. 40, but showing a light assembly with a wire jumper and a wire add on component connected thereto.

It should be emphasized that other variations of shelf light assemblies in accordance with the invention, can be achieved without departing from the principal concepts of the invention. This is particularly true with respect to variations in reflectance member configurations. With the reflectance member configurations, and with the adjustability thereof, an encapsulated product can be produced which will pass the maximum amount of light for particular applications, and will not require direct viewing. Accordingly, issues associated with hot spots and the like are not of any substantial relevance. With shelf light assemblies in accordance with the current invention, inexpensive flexible tape LED arrays can be utilized, and are replaceable in supporting aluminum tracks. Such replacement can be accomplished without the use of any complex tooling.

The reflectance members utilized in accordance with the invention provide for variable apertures of reflectance which significantly influence the light output from the LEDs. The capability of varying the particular configuration of the reflectance members, along with their positional adjustability provides for a wide scope of lighting configurations, without having to resort to completely new and distinct structures. As also previously described, a number of other reflectance member variations can be utilized. For example, it would be possible to utilize a fixed reflectance member on one side of the lighted assembly, while having a variable angled reflectance member on the other side. In fact, another variation in accordance with the invention is one where the tape light channel itself is positioned at a fixed angular relationship with the mounting surface. In this manner, the center output from the LEDs can be concentrated, and yet still be capable of adding aperture control for the reflectance members.

It will be apparent to those skilled in the pertinent arts that other embodiments of LED light assemblies in accordance with the invention can be designed. That is, the principles of the shelf light assemblies in accordance with the invention are not limited to the specific embodiments described herein. Accordingly, it will be apparent to those skilled in the arts that modifications and other variations of the above-described illustrative embodiments of the invention may be effected without departing from the spirit and scope of the novel concepts of the invention.

The invention claimed is:

1. A linear light assembly adapted for use as an LED-based source of light for illuminating product which is not sufficiently illuminated by ambient sources, said linear light assembly comprises:

an elongated flexible LED light component having a plurality of spaced-apart LEDs supported on a flexible base;

at least one metallic supporting track for supporting said linear light component;

an extruded sleeve having an elongated configuration for laterally enclosing said flexible LED linear light component, said sleeve having at least a portion thereof forming a section with translucent properties; and reflective means coupled to said sleeve for providing one or more reflective surfaces, and positioned relative to light emanating from said LED light component so as to achieve a predetermined light distribution.

2. A linear light assembly in accordance with claim 1, characterized in that said reflective means comprises at least one reflective member coupled to other elements of said linear light assembly, said at least one reflective member having an elongated and wing-like configuration.

3. A linear light assembly in accordance with claim 1, characterized in that said reflective means comprises at least one reflective member coupled to other elements of said linear light assembly, said at least one reflective member being angularly adjustable relative to said flexible LED light component between a first predetermined minimum angle and a second predetermined maximum angle.

4. A linear light assembly in accordance with claim 1, characterized in that said reflective means comprises at least one reflective member coupled to other elements of said linear light assembly, said linear light assembly being constructed and configured so that selectable positioning of said at least one reflective member so as to provide for substantial variations in the resultant intensity of light originating from said LED light component and reflected off of said at least one reflective member.

5. A linear light assembly in accordance with claim 1, characterized in that said reflective means are operable so as to provide a variable aperture of reflectance.

6. A linear light assembly in accordance with claim 1, characterized in that coupling means are provided for electrically coupling together a plurality of individual ones of said linear light assemblies, so as to produce a structure where said linear light assemblies are daisy chainable for a pre-determined distance, said pre-determined distance being dependent upon electrical and structural characteristics of said linear light assemblies.

7. A linear light assembly in accordance with claim 1, characterized in that said reflective means comprises at least one reflective member coupled to other elements of said linear light assembly.

8. A linear light assembly in accordance with claim 7, characterized in that said at least one reflectance member is configured and constructed relative to other elements of said linear light assembly, so as to be maintained in a stationary position following initial installation of said light assembly.

9. A linear light assembly in accordance with claim 7, characterized in that said at least one reflective member is coupled to other elements of said linear light assembly so as to be adjustably positionable relative to said flexible LED light component, and so as to permit adjustment of reflected light distribution for the linear light assembly.

10. A linear light assembly in accordance with claim 7, characterized in that said at least one reflective member is appended to a side of said extruded channel through a cylindrical pivot.

11. A linear light assembly in accordance with claim 7, characterized in that said at least one reflective member is utilized for concentration and direction of LED generated light to positions beneath or behind the location of said LED light component.

12. A linear light assembly in accordance with claim 7, characterized in that said at least one reflective member is constructed at least in part of plastic material.

13. A linear light assembly in accordance with claim 7, characterized in that said light assembly comprises a double channel for supporting a pair of elongated flexible LED linear light components.

14. A linear light assembly in accordance with claim 1, characterized in that:

at least one of said reflective members is configured and constructed so as to be maintained stationary relative to said LED light component following initial installation of said linear light assembly; and at least a second one of said reflective members is coupled to other components of said linear light assembly so as to be adjustably positionable relative to said LED light component.

15. A linear light assembly in accordance with claim 1, characterized in that at least two of said reflective members are constructed and configured so as to be maintained stationary relative to other components of said linear light assembly following installation of said linear light assembly.

16. A light assembly adapted for use as an LED-based source of light, said shelf light assembly comprises:

an elongated flexible LED tape light component having a plurality of spaced-apart LEDs supported on a flexible base;

at least one metallic track for supporting said tape light component, said metallic track having an elongated configuration;

at least one reflectance member assembly having a stationary wing and an adjustable wing, the adjustable wing movable with respect to the stationary wing, said reflectance member assembly being configured so as to provide a field of reflectance for light emanating from said LED tape light component.

* * * * *